United States Patent [19]

Langenbeck

[11] Patent Number: 4,748,791

[45] Date of Patent: Jun. 7, 1988

[54] BEVERAGE TRAY PACKING SYSTEM

[76] Inventor: Keith A. Langenbeck, 4005 University Blvd., Dallas, Tex. 75205

[21] Appl. No.: 76,389

[22] Filed: Jul. 22, 1987

Related U.S. Application Data

[63] Continuation-in-part of Ser. No. 889,734, Jul. 28, 1986, Pat. No. 4,704,841.

[51] Int. Cl.[4] ..... B65B 35/44; B65B 57/12; B65B 39/12; B65B 5/08

[52] U.S. Cl. ..... 53/58; 53/500; 53/534; 53/542; 53/251

[58] Field of Search ..... 53/58, 534, 55, 251, 53/242, 448, 542, 543, 475, 495, 498

[56] References Cited

U.S. PATENT DOCUMENTS

| | | | |
|---|---|---|---|
| 25,852 | 9/1965 | Nigrelli et al. | 53/251 X |
| 3,354,613 | 11/1967 | Anderson et al. | 53/251 |
| 3,478,491 | 11/1969 | Lattke | 53/534 X |
| 3,599,397 | 8/1971 | Standley et al. | 53/534 X |
| 4,389,832 | 6/1983 | Calvert | 53/534 X |
| 4,391,078 | 7/1983 | Nigrelli | 53/251 |
| 4,578,930 | 4/1986 | Simelunas et al. | 53/251 X |

FOREIGN PATENT DOCUMENTS

| | | | |
|---|---|---|---|
| 1433134 | 4/1976 | United Kingdom | 53/534 |

*Primary Examiner*—Horace M. Culver

*Attorney, Agent, or Firm*—W. Kirk McCord

[57] ABSTRACT

A system for packing containers, such as beverage containers, into corresponding transport trays is comprised of a first conveyor track on which the containers are transported and a second conveyor track on which the trays are transported. A portion of the second conveyor track is inclined with respect to the first conveyor track so that the first and the second tracks converge at a predetermined location. A plurality of relatively flat, elongated support members are mounted at the downstream end of the first track adjacent to the predetermined location for journally supporting a discrete group of containers while the containers are being packed into the corresponding tray. The support members are reciprocally movable between a first position at which the support members are fully extended for introducing the containers into the tray and a second position at which the support members are fully retracted for allowing the trailing edge of the corresponding tray to clear the support members as the tray is moved along the inclined portion of the second track after all of the containers of the corresponding group have been packed into the tray. Each group of containers is packed into the corresponding tray into succession from the leading edge to the trailing edge of the tray while the tray is being moved upwardly along the inclined portion of the second track.

22 Claims, 17 Drawing Sheets

BEVERAGE TRAY PACKING SYSTEM

BACKGROUND OF THE INVENTION

This is a continuation-in-part of applicant's co-pending application Ser. No. 889,734, filed July 28, 1986, and now U.S. Pat. No. 4,704,841.

FIELD OF THE INVENTION

The present invention relates generally to tray packing systems and in particular to a system for packing individual beverage containers into a tray for further transport.

Beverages, such as soft drinks and beer, are distributed commercially in glass and plastic bottles and in aluminum cans. Single service beverage containers, which typically contain six to twenty-four ounces of the beverages, are usually grouped into individual cases, each usually containing twenty-four individual containers. These cases may be further subdivided into groups of six, eight or twelve individual beverage container packages.

Typically, each case of beverage containers is loaded into a seperate tray for transport from the site of a bottling company to the point of sale, such as at a grocery store. Such trays are typically made of wood, corrugated paper or plastic. Many of these trays, corrugated paper types in particular, are usually disposed of after the beverage containers are removed from their trays at their respective points of sale.

DESCRIPTION OF THE PRIOR ART

Automated systems for loading individual beverage containers into respective trays for transportation are known in the art. According to prior practice, such automated systems typically fall into one of the following three categories: (1) tray former loader system; (2) vertical drop/set packer systems; and (3) ski packer systems. All such systems rely on synchronization between the movement of the individual cans or bottles on a first conveyor track with the movement of the individual trays into which the cans or bottles are to be packed on a second conveyor track.

In tray former loader systems a corrugated paper tray is typically pushed onto the track carrying the beverage containers at right angles with respect to the direction of movement thereof. The leading edge of the tray is folded up to catch the cans on the leading edge and subsequently the side edges and back edge of the tray are folded up to form the container. Tray former loader systems have the advantage of being relatively fast in that they can package approximately 60–80 cases per minute, but have the disadvantage of being relative complex and costly and the corrugated paper tray is not reusable. The cost of a typical tray former loader system is on the order of $150,000–$250,000.

Vertical drop/set packer systems employ a device for dropping/setting the individual beverage containers vertically downward into a pre-formed transport tray. This type of system has the disadvantage of being relatively slow in that it is only able to process approximately 30–35 cases per minute, but the system can pack individual containers into a wide variety of tray types and designs.

Ski packer systems use a spring-loaded mechanism, which is tripped by the weight of the individual beverage containers. when the mechanism is tripped, 24 individual beverage containers comprising a case are launched down a ramp and into a transport tray. Because of the manner in which the cans are launched into the tray, the vertical depth of the tray must be greater than one-half of the height of the individual beverage containers in order to properly capture the containers within the tray. ski packer systems can typically process approximately 50–55 cases per minute. Although ski packer systems are useful for loading six-packs into transport trays, they are not well-suited for packing individual beverage containers. Ski packer systems typically use pre-formed, non-reusable corrugated paper trays.

Various types of tray packing systems are described in U.S. Pat. Nos. Re. 25,852; 3,354,613; 3,478,491; 3,599,397; 4,389,832; 4,391,078; and 4,578,930 and in British Pat. No. 1,433,134.

OBJECTS OF THE INVENTION

It is, therefore, the principal object of the present invention to provide an improved system for packing beverage containers into a transport tray.

Another object of the invention is to provide a more reliable and less expensive system for loading beverage containers into a transport tray.

Still another object of the invention is to provide a system for loading beverage containers into a transport tray, which is suitable for loading both pre-packaged containers and individual loose containers.

Yet another object of the invention is to provide a faster and more economical system for packing beverage containers into a transport tray.

A further object of the invention is to provide a system for packing beverage containers into a transport tray without unnecessarily interrupting or slowing the movement of the beverage containers along a primary conveyor track.

SUMMARY OF THE INVENTION

These and other objects are accomplished in accordance with the present invention wherein an improved system for packing containers into transport trays is provided. The system is comprised of first conveyor means for transporting the containers along a first track; means for dividing the containers into selected groups, the number of containers in each group corresponding to the number of containers to be packed into each tray; second conveyor means for transporting the trays along a second track, a portion of the second track being inclined with respect to the first track so that the first and second tracks converge at a predetermined location; a support member disposed adjacent to a downstream end of the first track for journally supporting the containers as the containers are being packed into the corresponding tray; and means for controlling the movements of the containers on the first track and the trays on the second track so that each group of containers is packed into the corresponding tray in succession from the leading edge to the trailing edge of the tray while the tray is being moved upwardly along the inclined portion of the second track. The support member is reciprocally movable along an upstream-downstream axis between a first position at which the support member is substantially fully extended for introducing a corresponding group of containers into the corresponding tray and a second position at which the support member is substantially fully retracted for allowing the trailing edge of the corresponding tray to clear the support member as the tray is moved along the inclined portion of the second track after all of the containers in the corresponding group have been packed into the tray.

In one aspect of the invention, means is provided for selectively moving the support member between the first and second positions. The moving means is comprised of cam means which is movable along the first track and stationary spring-loaded push rod follower means coupled to the support member for engaging the cam means as the cam means is moved along the first track. The cam means exerts downward pressure on the push rod follower means to move the support member to the second position when the cam means is in engagment with the push rod follower means. The push rod follower means is moved upwardly by spring-bias when the push rod follower means is not in engagement with the cam means to move the support member to the first position. In one embodiment the push rod follower means is comprised of a spring-loaded push rod follower, the major axis of which is oriented substantially orthogonal with respect to the major surface of the first track so that the push rod follower is movable along its major axis, and linkage means coupled between the push rod follower and the support member for translating the axial motion of the push rod follower into corresponding reciprocating motion of the support member along the upstream-downstream axis of the first track.

In the preferred embodiment the system includes a plurality of support members, each of which is comprised of a relatively flat elongated member. The first track includes a corresponding plurality of complementary elongated openings for receiving respective ones of the support members when the support members are moved from the first position to the second position. Each of the support members journally supports a corresponding column of containers, in which the individual containers are arranged along the upstream-downstream axis, when a group of containers is being journally supported by the support members. Each support member further includes an extension portion for engaging a corresponding facing surface of the first track for preventing the corresponding support member from being moved along an axis which is normal with respect to the major surface of the first track.

The cam means is preferably comprised of a plurality of cams disposed at predetermined positions on the first conveyor means so that one of the cams comes into contact with the push rod follower means while a corresponding group of containers is being packed into the corresponding tray, to begin moving the support members from the first position to the second position. Each of the cams has a length along the upstream-downstream axis which is sufficient to engage the push rod follower to maintain the support members in the second position during the time period beginning just prior to the arrival of the trailing edge of the corresponding tray at the predetermined location and ending just after the arrival of the leading edge of the next tray in sequence at the predetermined location.

BRIEF DESCRIPTION OF THE DRAWINGS

Other objects and advantages of the invention will be apparent from the detailed description and claims when read in conjunction with the accompanying drawings wherein:

DETAILED DESCRIPTION OF THE PREFERRED EMBODIMENT

In the description which follows, like parts are marked throughout the specification and drawings, respectively. The drawings are not necessarily to scale and in some instances proportions have been exaggerated in order to more clearly depict certain features of the invention.

Figure 1:
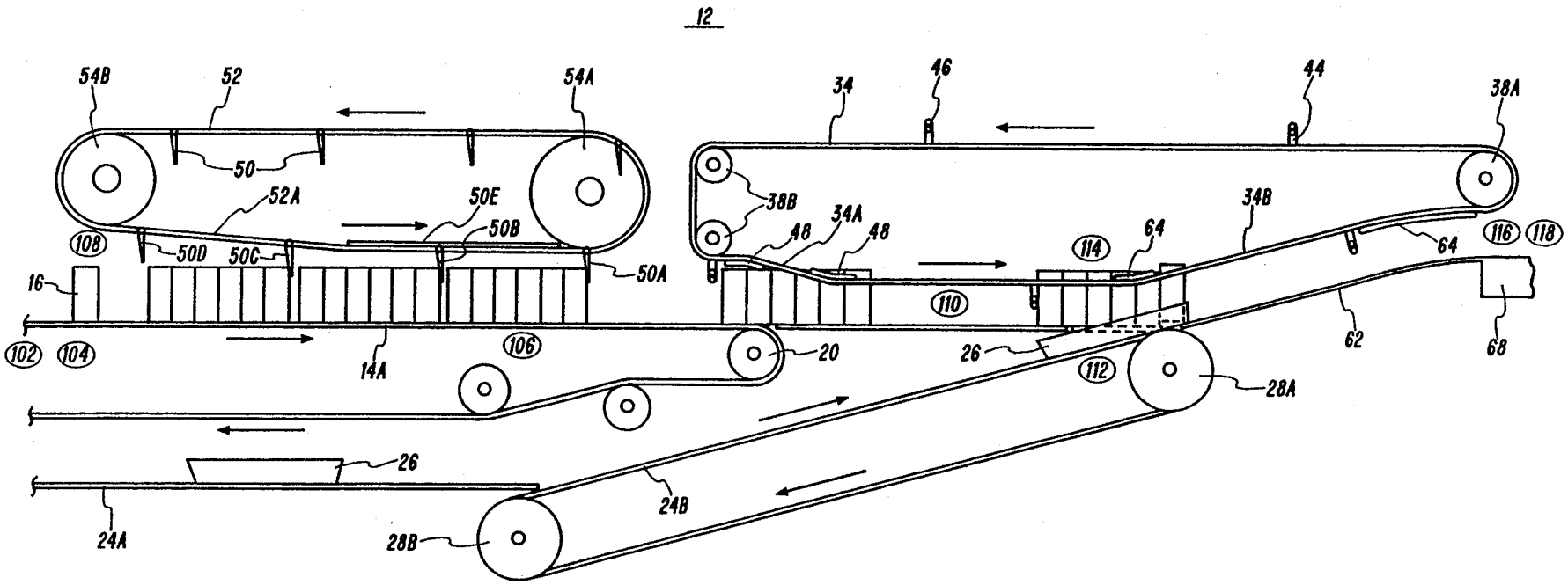
FIGS. 1 and 2 are side elevation view of the tray packing system according to the present invention.
Figure 2:
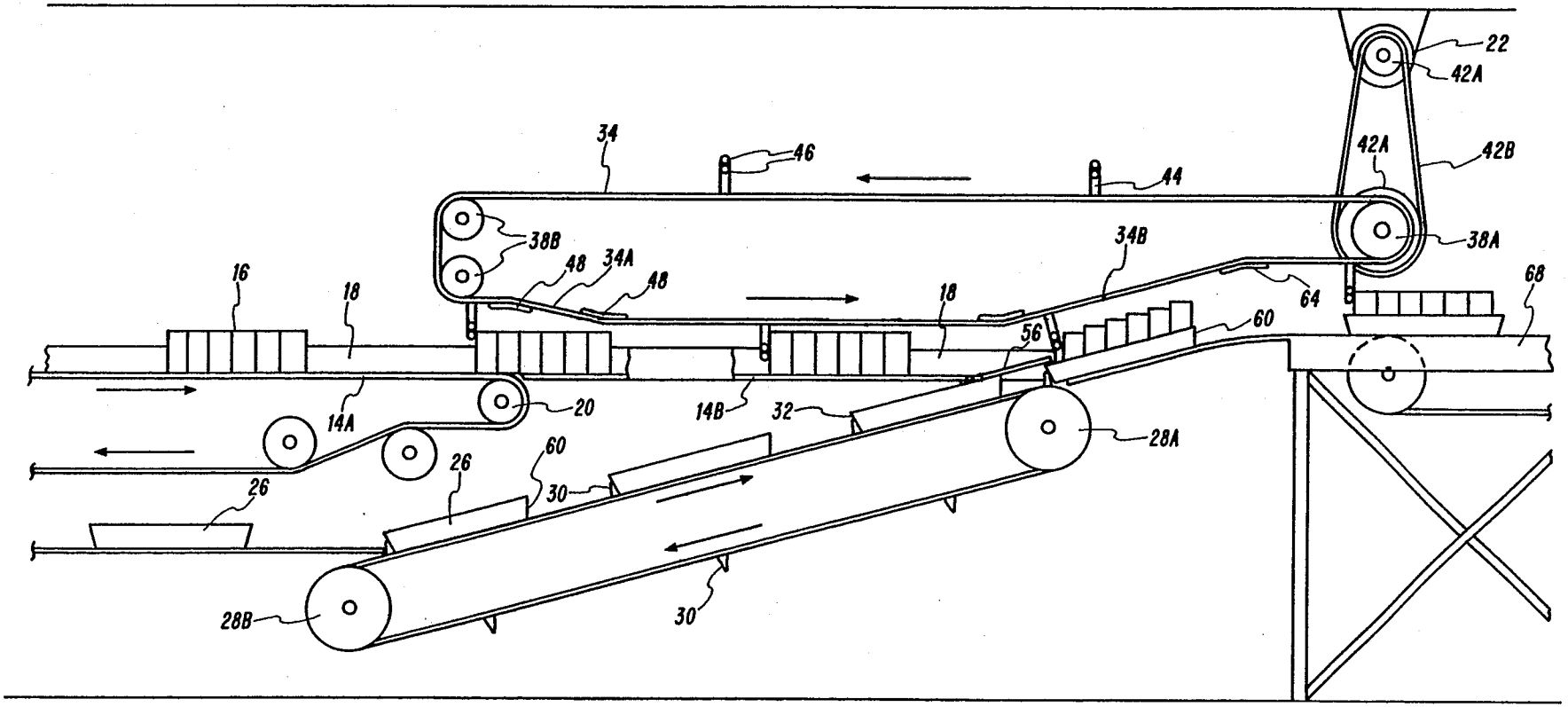

Referring to FIGS. 1 and 2, an automated system for packing beverage containers, such as soft drink cans, into transport trays according to the present invention is depicted. Packing system 12 includes a first conveyor track 14 on which individual beverage containers 16 are transported. Containers 16 may be pre-packaged into six-packs, eight-packs or twelve-packs or, alternatively, individual containers 16 may be transported in a loose state on first conveyor track 14. First conveyor track 14 includes a movable portion 14A, which is preferably comprised of a portion of a first sprocket-driven chain member, and a stationary portion 14B, which may be comprised of one or more chain members, downstream of movable portion 14A. First conveyor track 14 has side walls 18 along substantially the entire length thereof to keep containers 16 on first track 14. End sprocket 20 is preferably driven by an electric motor (not shown) to drive the first chain member comprising movable track 14A in a continuous loop in the direction indicated by the two arrows.

A second conveyor track 24 for transporting individual trays 26 into which containers 16 are to be loaded is comprised of a substantially horizontal portion 24A and a substantially inclined portion 24B, which is downstream of horizontal portion 24A. Inclined portion 24B is preferably comprised of a conveyor belt, which is wound around two opposed drive drums or pulleys 28A and 28B to form a continuous loop. An electric motor (not shown) or other suitable drive mechanism is preferably connected to drive drum 28A for driving inclined track 24B in the direction indicated by the appropriate arrows. Inclined track 24B further includes a plurality of support projections 30 arranged at predetermined intervals therealong for engaging the respective trailing edges 32 of trays 26 to push each tray 26 upwardly along inclined track 24B.

Figure 3:
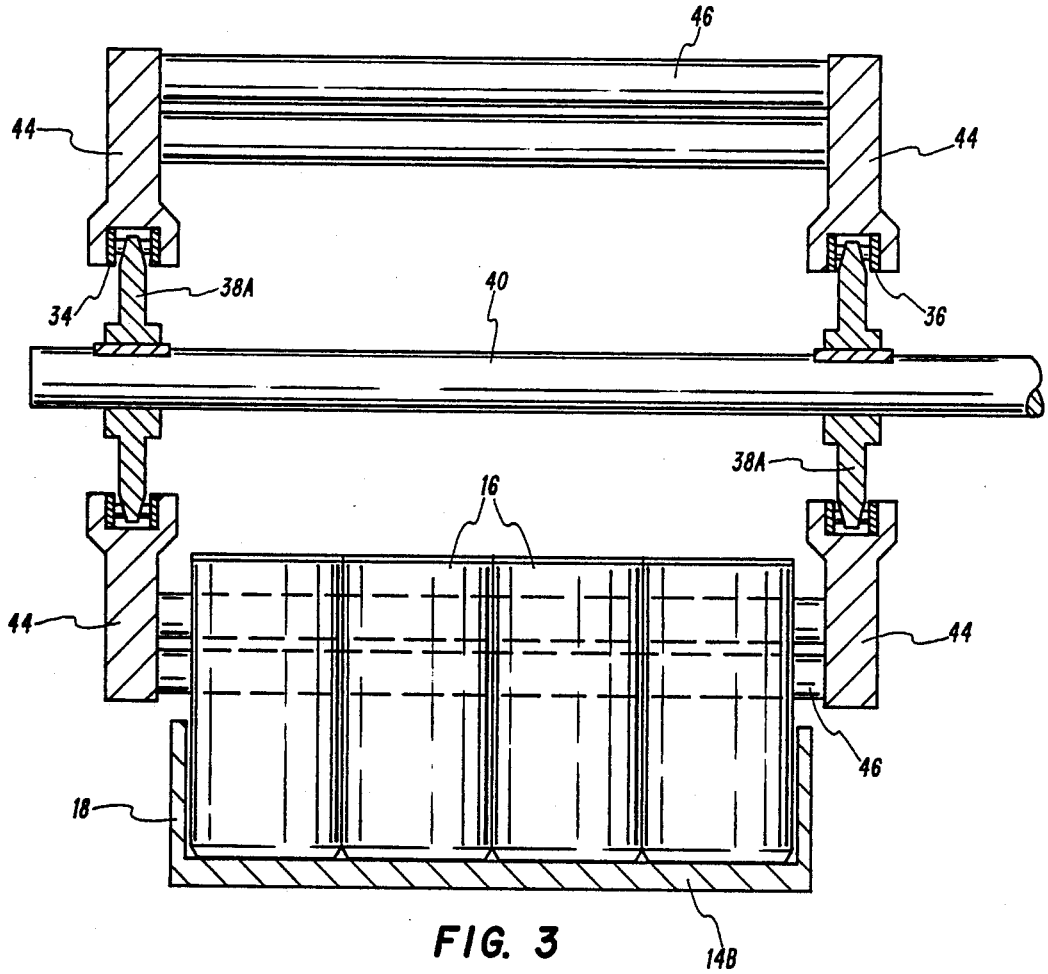
FIG. 3 is an end elevation view of the tray packing system shown in FIGS. 1 and 2, looking from the downstream side toward the upstream side.

Referring also to FIG. 3, containers 16 are transported along stationary track 14B by means of a chain and sprocket arrangement comprising second and third chain members 34 and 36 wound around respective sprocket members 38A and 38B to form respective continuous vertical loops in substantially parallel orientation with respect to one another, as best seen in FIG. 3. Each sprocket member 38A and 38B associated with second chain member 34 is coupled to the corresponding sprocket member 38A and 38B, respectively, associated with third chain member 36 by means of a common shaft 40, which fits within a complementary keyway in the corresponding sprocket member 38A and 38B, thereby allowing second and third chain members 34 and 36 to be driven together in respective continuous vertical loops. A drive motor 22, which is preferably a variable speed AC motor, is coupled to sprocket member 38A on second chain member 34 via pulleys 42A and belt 42B to impart rotational motion to sprocket member 38A and drive second chain member 34. Shaft members 40 connecting corresponding sprocket members 38A and 38B on the respective second and third chain members 34 and 36 transfer the drive force to third chain member 36 to drive third chain member 36 in conjunction with second chain member 34.

Second and third chain members 34 and 36 each have a plurality of flight bars 44 extending outwardly therefrom at predetermined intervals therealong. Each flight bar 44 on second chain member 34 is connected to the corresponding flight bar 44 on third chain member 36 by means of a series of rollers 46, which span the gap between the corresponding pairs of flight bars 44. Rollers 46 contact the trailing row in each group of containers 16 across substantially the entire width thereof, as best shown in FIG. 3, to move each group of containers 16 along stationary track 14B.

Second and third chain members 34 and 36 preferably include respective portions which extend downward at a gradual angle (for example, 5°) with respect to the horizontal, as indicated at 34A by means of shoe plates 48. As flight bars 44 travel along a slightly descending path, they will contact the trailing row in each group of containers 16 at a lower point on each container than if fight bars 44 were moving horizontally. Therefore, containers 16 are less susceptible to being tipped over by the force exerted upon them by flight bars 44. Furthermore, the flight bars can be made of short length because inclined portions 34A allow the corresponding flight bars 44 to contact containers 16 at respective lower positions thereon. One skilled in the art will appreciate, however, that inclined portions 34A can be eliminated and second and third chain members 34 and 36 driven substantially horizontally, but that longer flight bars would have to be used to insure that contact is made low enough on the respective surfaces of containers 16 to prevent container 16 from tipping over as a result of the force imparted thereto by flight bars 44.

Figure 4:
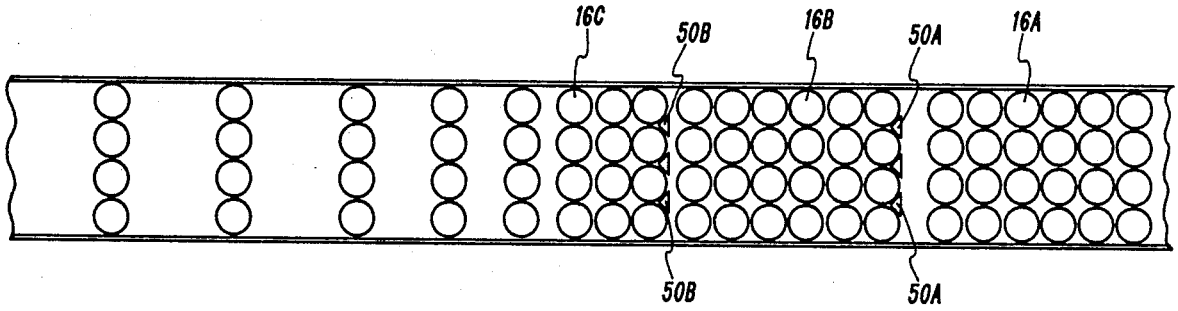
FIG. 4 is a top plan view illustrating the separation of individual beverage containers into discrete groups.

Referring to FIGS. 1 and 4, individual ones of containers 16 are separated into groups of twenty-four containers 16 in each group, corresponding to a standard case of containers. Finger-like dividers 50 are disposed at predetermined intervals along a plurality of mounting bars (not shown), which extend laterally between fourth and fifth sprocket-driven chain members 52 (only one of which is shown in FIG. 1). Each chain member 52 is wound around a pair of sprockets 54A and 54B to form respective continuous vertical loops. Fourth and fifth chain members 52 are disposed in parallel relationship with respect to one another and driven together in much the same manner as second and third chain members 34 and 36 are driven together, as described above. Dividers 50 are preferably pivotally attached to their respective bars and hang vertically downward therefrom. A retaining bar 56 holds dividers 50A and 50B in a substantially rigid position when dividers 50A and 50B are interposed between containers 16. In an alternate embodiment, dividers 50 are held in a rigid position at all times and are therefore not able to swing freely with respect to their corresponding mounting bars.

Dividers 50 are interposed between selected rows of containers 16 on movable track 14A and dividers 50 are moved by fourth and fifth chain members 52 in the direction of movement of movable track 14A, but a somewhat slower speed than movable track 14A so that a relative speed differential is maintained between those containers 16 on the downstream side of dividers 50A and those containers 16 on the upstream side thereof, as best illustrated in FIG. 4. If containers 16 are arranged as shown in FIG. 1, with six rows, each containing four containers 16 extending laterally across movable track 14A, each lateral mounting bar will have three dividers 50 extending therefrom so that one divider 50 is interposed between adjacent containers 16 in the leading row of each group of containers 16. Each set of dividers 50 on a particular mounting bar is separated from the next adjacent set by approximately the length of each group of containers 16, as measured longitudinally along movable track 14A. One skilled in the art will appreciate that containers 16 can also be arranged in groups of twenty-four containers 16 each, with four rows, each containing six containers 16. In that event, each lateral mounting bar will have five dividers 50 extending therefrom.

Respective portions 52A of fourth and fifth chain members 52 extend downwardly at a gradual angle (for example, 5) with respect to a horizontal axis, to allow dividers 50 to move gradually downward over the tops of containers 16 into position between containers 16, as best illustrated by dividers 50C and 50D in FIG. 1. The operation of dividers 50 is timed so that a case consisting of twenty-four individual containers 16 will be grouped together between adjacent sets of dividers 50.

FIG. 4 illustrates three different cases of containers 16, each consisting of twenty-four individual containers 16, in the process of being formed on movable track 14A. Case 16A is moving downstream along movable track 14A at a relative speed differential with respect to case 16B because case 16A is no longer being held back by dividers 50. Thus, case 16A moves at the speed of movable track 14A, while case 16B is confined by first set of dividers 50A, which is in contact with the leading row of case 16B, thereby limiting the speed of movement of case 161B to the speed of movement of dividers 50A. Upstream of second set of dividers 50B, a third case 16C is being formed or has been formed as the individual containers 16 stack up on the upstream side of dividers 50B. As fourth and fifth chain members 52 continue their movement, dividers 50A will move upwardly and away from the leading row of case 16B to allow case 16B to move downstream at the speed of movable track 14A. The net result of the above-described operation is that individual containers 16 will be grouped into cases consisting of twenty-four containers 16. Each case will be spaced apart sufficiently to allow the corresponding flight bars 44 to make contact with the trailing row of containers 16 in each case, as best seen in FIG. 1. One skilled in the art will appreciate that fourth and fifth chain members 52 may be positioned beneath movable track 14A in an alternate embodiment so that dividers 50 are interposed between containers 16 from underneath.

Referring to FIGS. 2 and 5A–5I, a ramp 56 is pivotally attached at the downstream end of stationary track 14B. Ramp 56 is mounted so as to be rotatable in an upward direction about an axis extending laterally across stationary track 14B. Ramp 56 includes an extension portion 58 which engages the under-surface of stationary track 14B to act as a stop and prevent ramp 56 from being rotated below a substantially horizontal position at the level of stationary track 14B. Each case of containers 16 is pushed off ramp 56 by the corresponding flight bar 44 into the corresponding tray 26. As each tray 26 moves up inclined track 24B, trailing edge 32 of the corresponding tray 26 that is being filled with contact ramp 56, causing ramp 56 to pivot upwardly to allow tray 26 to continue its upward movement along inclined track 24B.

Figure 5A:
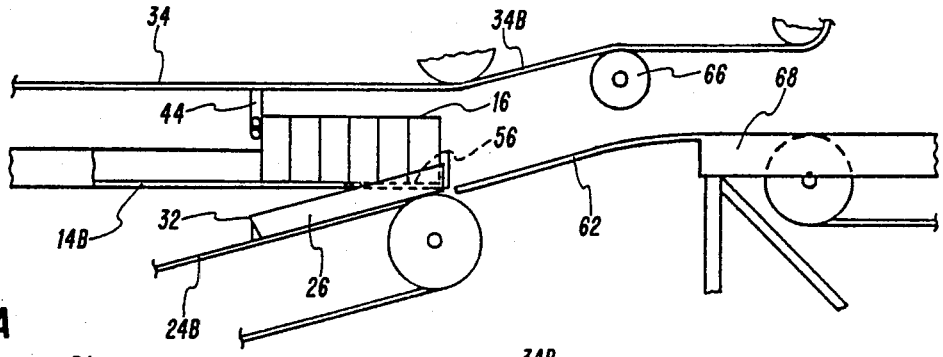
FIGS. 5A–5I are side elevation views of a portion of the tray packing system of FIGS. 1 and 2, showing the successive steps in which containers are loaded into the trays.
Figure 5B:
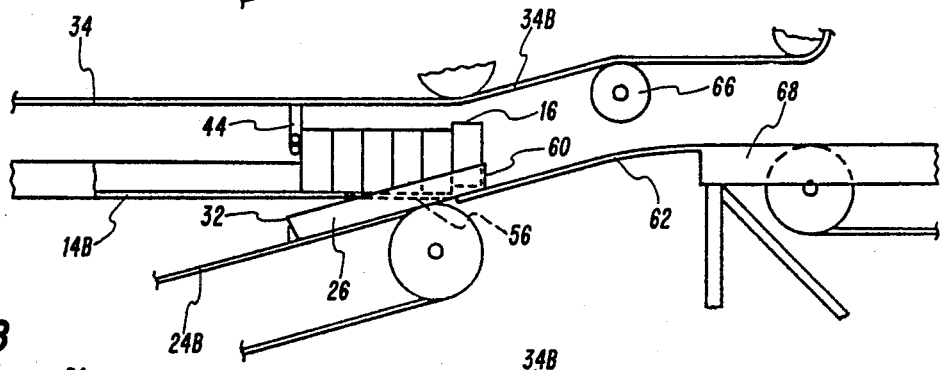
Figure 5C:
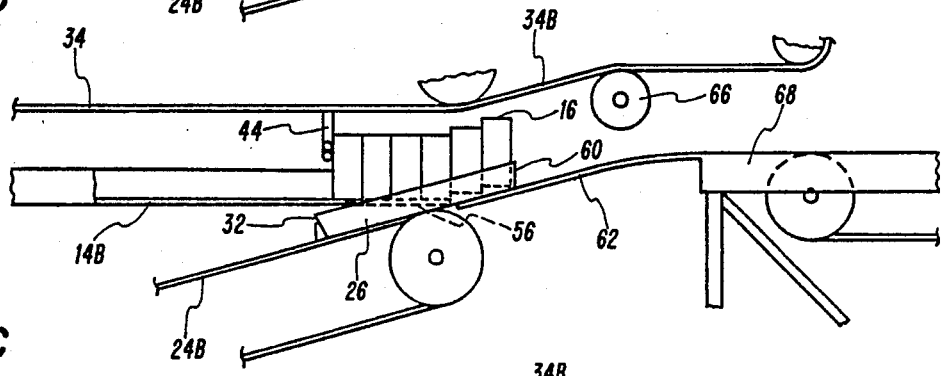
Figure 5D:
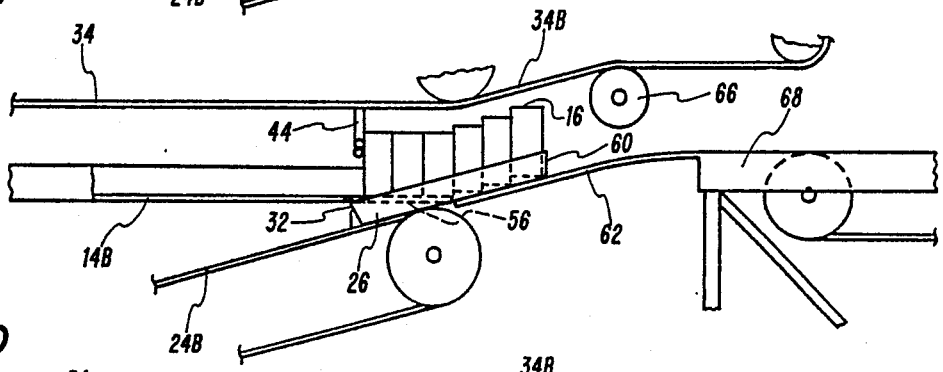
Figure 5E:
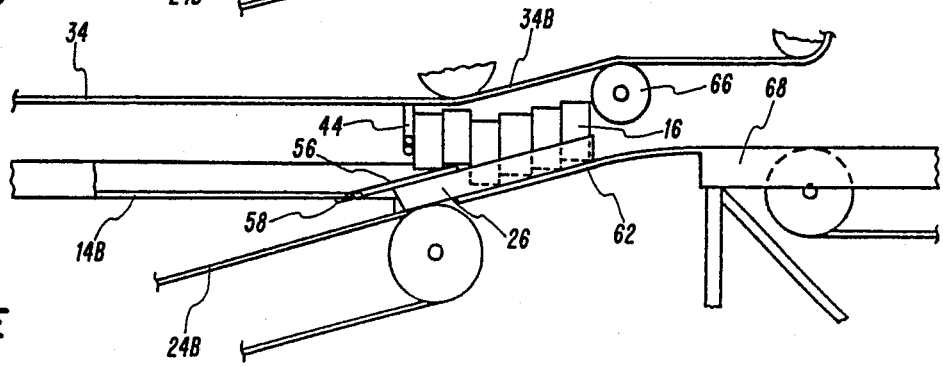
Figure 5F:
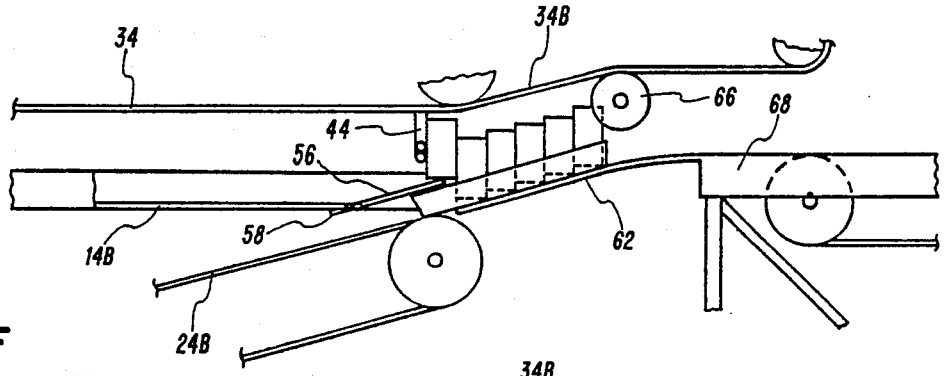

Referring specifically to FIGS. 5A and 5B, when the downstream end of ramp 56 clears leading edge 60 of each tray 26, ramp 56 will return to a substantially horizontal position. At this point, the leading row of containers 16 has reached the upstream edge of extension portion 58 of ramp 56. A corresponding flight bar 44 continues to push each case of containers 16 downstream and tray 26 continues to move upwardly along inclined track 24B so that the leading row of containers 16 is loaded into tray 26. The leading row is maintained in a substantially vertical orientation and is sandwiched between leading edge 60 of tray 26 and the second row of containers 16. The bottom surface of tray 26 is oriented at a substantially acute angle with respect to the corresponding bottom surfaces of containers 16 so that containers 16 appear to be "leaning forward" with respect to the bottom surface of tray 26. The second and third rows of containers 16 are loaded in tray 26 in substantially the same manner, as shown in FIGS. 5C and 5D, as flight bar 44 continues to push containers 16 downstream along stationary track 14B and the corresponding tray 26 continues its upward movement along inclined track 24B.

Referring specifically to FIG. 5, ramp 56 will begin to move upwardly again as it comes into contact with trailing edge 32 of tray 26. Thus, the fourth, fifth and sixth rows of containers 16 will be pushed off the front edge of ramp 56 by flight bar 44 and slide a short vertical distance downward into tray 6, as shown in FIGS. 5E, 5F and 5G. One skilled in the art will recognize that each row of containers 16 is maintained in a relatively stable vertical orientation during the packing process by the container row immediately in front and immediately behind it, except for the first container row, which is stabilized in front by leading edge 60 of the corresponding tray 26, and the sixth container row, which is stabilized from behind by flight bar 44. Side walls 48 on either side of ramp 56 stabilize containers 16 laterally as containers 16 are loaded into coresponding trays 26. After tray 26 has been filled with containers 16, each container 16 is in contact with the corresponding adjacent containers 16 in all directions and the containers on the outside of the configuration will be in contact with the corresponding adjacent walls of the tray to achieve a tightly packed configuration.

Figure 5G:
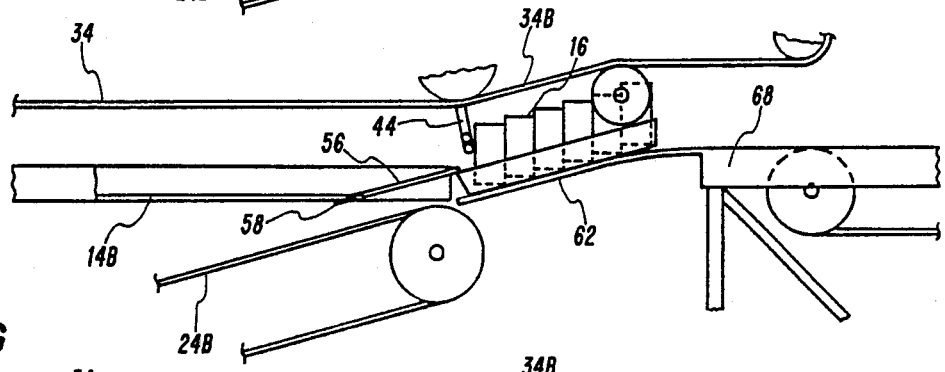
Figure 5H:
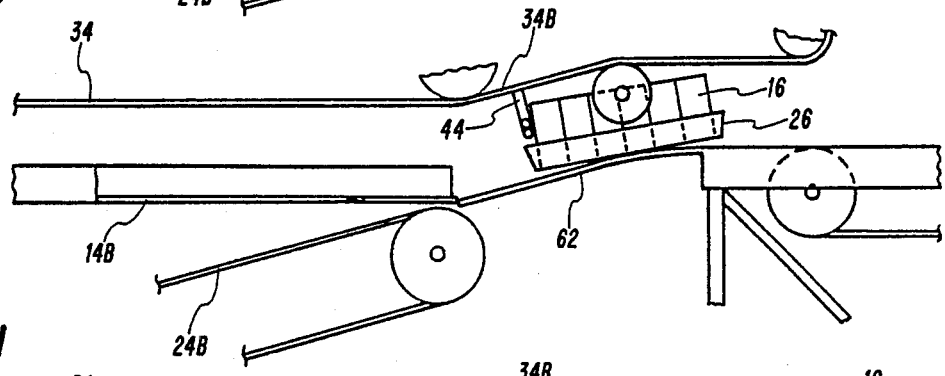

Referring to FIGS. 5G and 5H, all twenty-four containers 16 in each case are shown in the packed position within the corresponding tray 26 according to the above-described process. At this point, tray 26 is transported upwardly along a stationary inclined track 62 by the corresponding flight bar 44. Second and third chain members 34 and 36 are inclined upwardly, as shown at 34B, along substantially the same angle as inclined track 62, by means of a shoe plate 64 (FIGS. 1 and 2) or an idler sprocket 66 (FIGS. 5A–5I) so that the force imparted by the corresponding flight bar 44 will be directed substantially parallel with respect to inclined track 62.

Figure 5I:
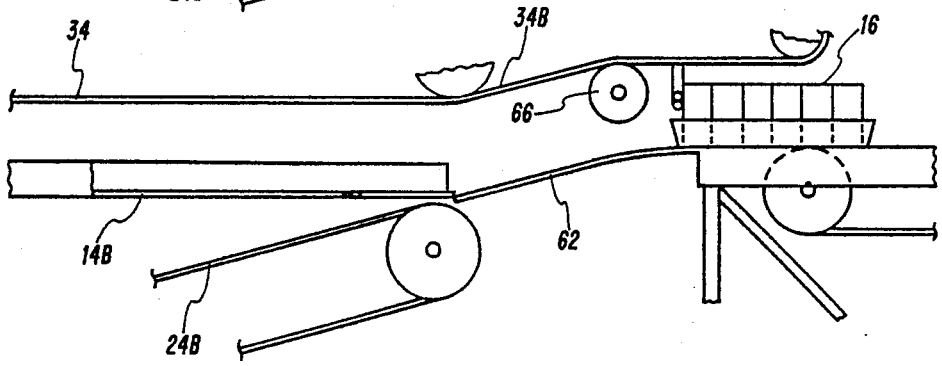

The corresponding bottom surfaces of each container 16 will remain oriented at an angle with respect to the bottom surface of tray 26 until tray 26 returns to a substantially horizontal position on a movable third conveyor track 68, as shown in FIGS. 5H and 5I. When tray 26 reaches a substantially horizontal position, containers 16 will "rock back" gently within tray 26 to achieve a stable, upright position for further transport. Shortly after the loaded tray 26 is transported onto third conveyor track 68, flight bar 44 rotates upwardly around drive sprocket 38A and becomes disengaged from the trailing row of containers 16. Tray 26 is transported downstream by the drive mechanism (not shown) associated with third conveyor track 68 to the next destination.

The tray packing system according to the present invention includes separate apparatus (preferably adjustable speed AC motors) for driving first chain member 14A, second conveyor track 24 and second and third chain members 34 and 36. Fourth and fifth chain members 52 may be mechanically slaved to second and third chain members 34 and 36 so as to be driven thereby, or alternatively, fourth and fifth chain members 52 may be equipped with a separate drive apparatus, which is electrically slaved by means of a feedback loop to the drive apparatus for second and third chain members 34 and 36. In order to effect a smooth transition between movable track 14A on which containers 16 are transported and stationary portion 14B on which flight bars 44 impart the motive force to containers 16, the speed of second and third chain members 34 and 36 must be equal to or greater than the speed of fourth and fifth chain members 52. The apparatus for driving first chain member 14A, second conveyor track 24, second and third chain members 34 and 36 and fourth and fifth chain members 52 will hereinafter be referred to as Drive 1, Drive 2, Drive 3 and Drive 4, respectively.

In the embodiment described above with reference to FIGS. 5A–5I, ramp 56 is lifted up by trailing edge 32 of the tray 26 being packed and leading edge 60 of the next tray 26 in sequence. Referring to FIGS. 6 and 7, an alternate embodiment for lifting ramp 56 is depicted. A cam 70 is attached by means of a link pin 70A to each of second and third chain members 34 and 36 at predetermined locations therealong, just upstream of each flight bar 44. A push rod follower 72 is attached to extension portion 58 of ramp 56 on each side of stationary track 14B, for engaging cam 70 as cam 70 moves past push rod follower 72 along with the respective second and third chain members 34 and 36.

Figure 6A:
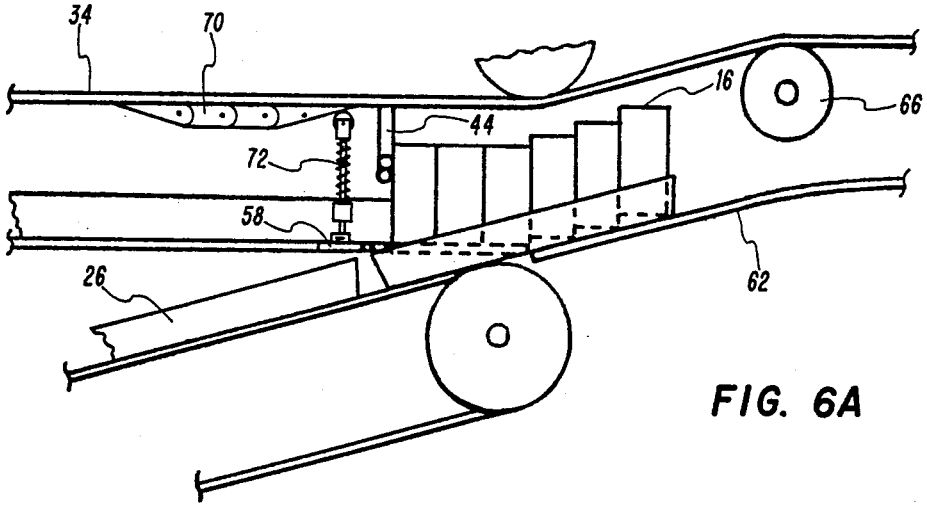
FIGS. 6A–6C are side elevation views of a portion of the tray packing system according to the present invention, showing a push rod follower mechanism for lifting the packing ramp on the container conveyor track.
Figure 7A:
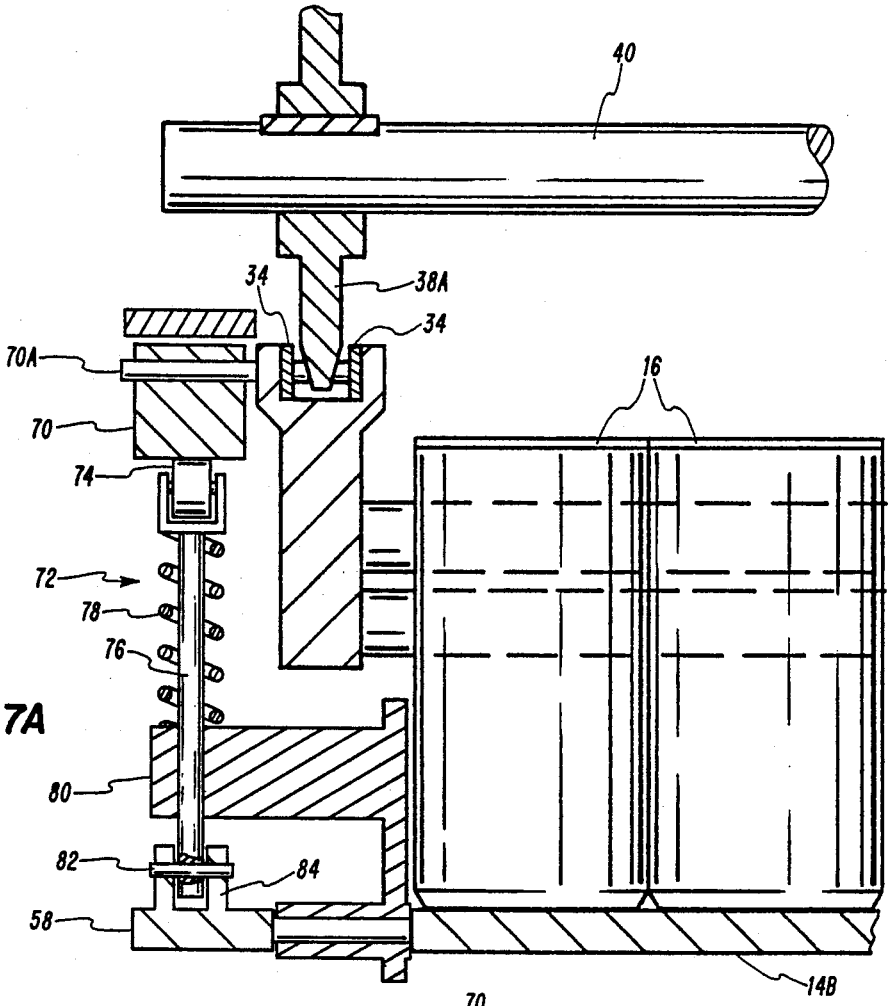
FIGS. 7A and 7B are respective sectional and side elevation views of the push rod follower mechanism shown in FIGS. 6A and 6B.
Figure 7B:
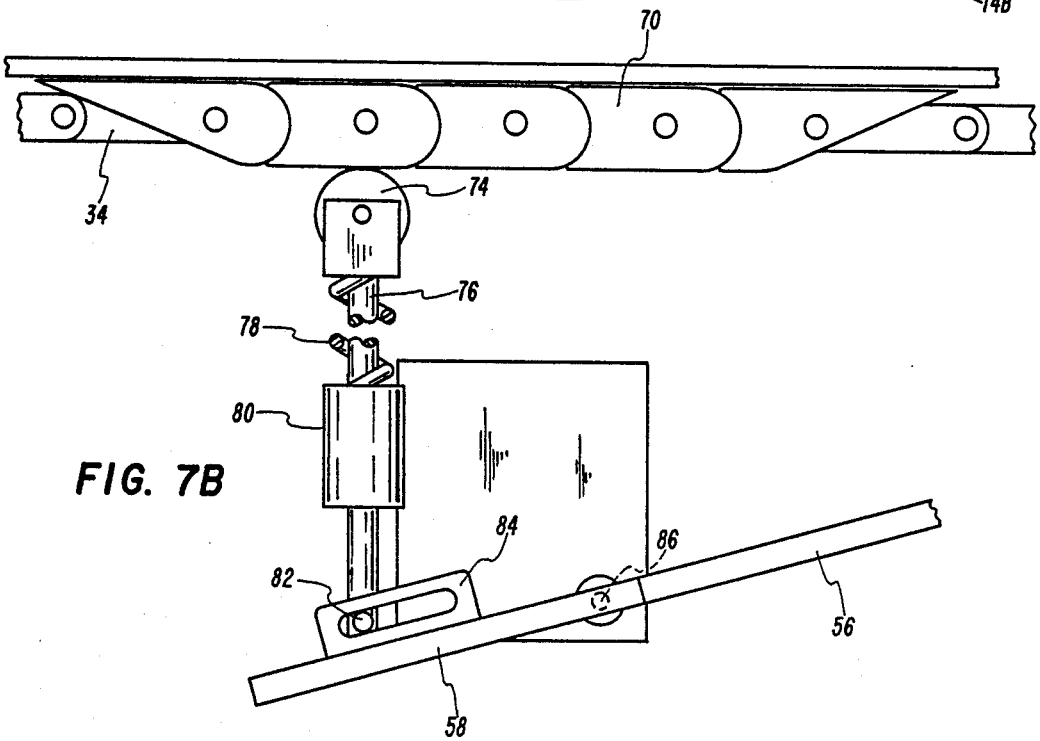

As best seen in FIGS. 7A AND 7B, push rod follower 72 is spring-biased toward the position shown in FIG. 6A, at which ramp 56 is in a substantially horizontal position as shown. Push rod follower 72 includes a cam follower 74 for engaging cam 70, an elongated shaft 76 on which spring member 78 is mounted, a guide 80, which constrains shaft 76 to move in a substantially vertical direction, a pin member 82 extending perpendicularly with respect to the axis of shaft 76 and a slotted bracket 84 mounted on extension portion 58 of ramp 56.

Figure 6B:
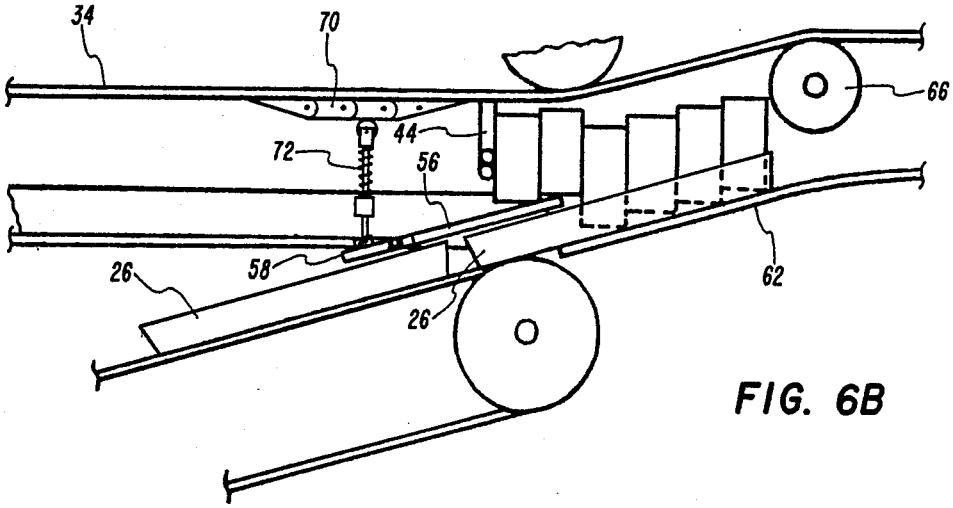
Figure 6C:
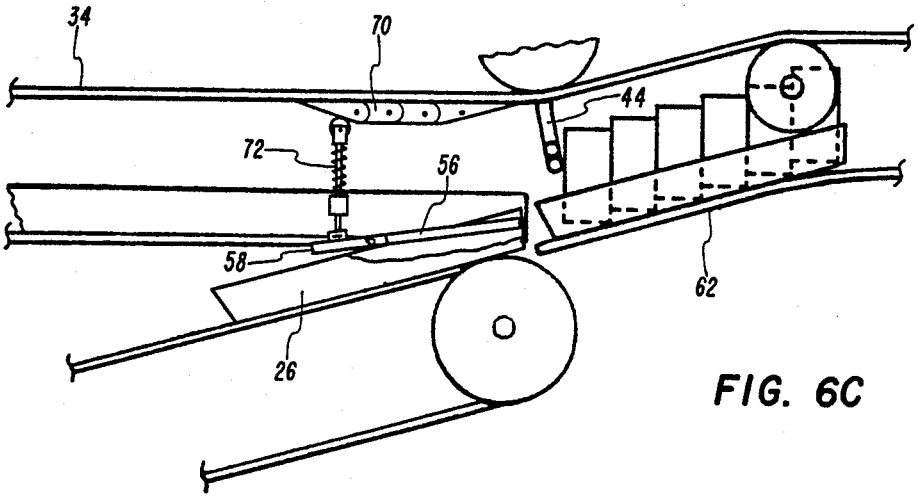

Referring specifically to FIGS. 6B, 7A and 7B, cam follower 74 is moved downwardly against the bias of spring member 78 as cam 70 passes over cam follower 74. When shaft 76 of push rod follower 72 is moved vertically downward by cam 70, it pushes down on extension portion 58, which pivots ramp 56 about pivot point 86, thereby raising ramp 56 upwardly to facilitate the passage of trays 26. Ramp 56 is lifted as required without relying on the lifting action of trailing edge 32 of the tray 26 being filled and leading edge 60 of the next tray 26 in sequence, which may cause stresses and possible damage to the edges of trays 26. Cam 70 and push rod follower 72 will cooperate to lift ramp 56 at the point where trailing edge 32 of each tray 26 contacts ramp 56, as best shown in FIG. 6A. Thus, the length of cam 70 must be greater than the longitudinal extent of containers 16 remaining on ramp 56 and not yet loaded into the corresponding tray 26. For example, in FIG. 6A, three rows of containers 16 are shown resting on ramp 56. Cams 70 are of sufficient length to hold the corresponding push rod followers 72 in a downward position to maintain ramp 56 in a raised position as shown until all of containers 16 have been loaded into the corresponding tray 26 and leading edge 60 of the next tray 26 in sequence has cleared the downstream end of ramp 56 to allow the next case of containers 16 in sequence to be loaded into the next tray 26 in sequence in the same manner as described above. Cams 70 are positioned on respective second and third chain members 34 and 36 so that the leading edge of each cam 70 will contact cam follower 74, as shown in FIG. 6A, at or just prior to when trailing edge 32 of the corresponding tray 26 would contact ramp 56 downstream of pivot point 86, as shown in FIG. 6A.

Figure 8A:
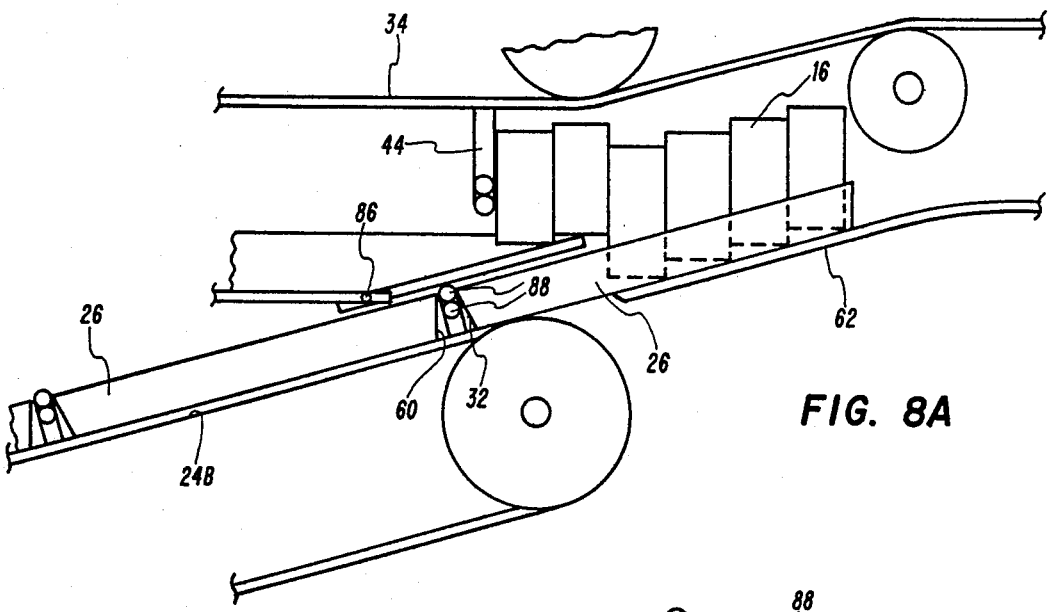
FIGS. 8A and 8B are respective side elevation and perspective views of a first roller mechanism used to lift the packing ramp according to the present invention.
Figure 8B:
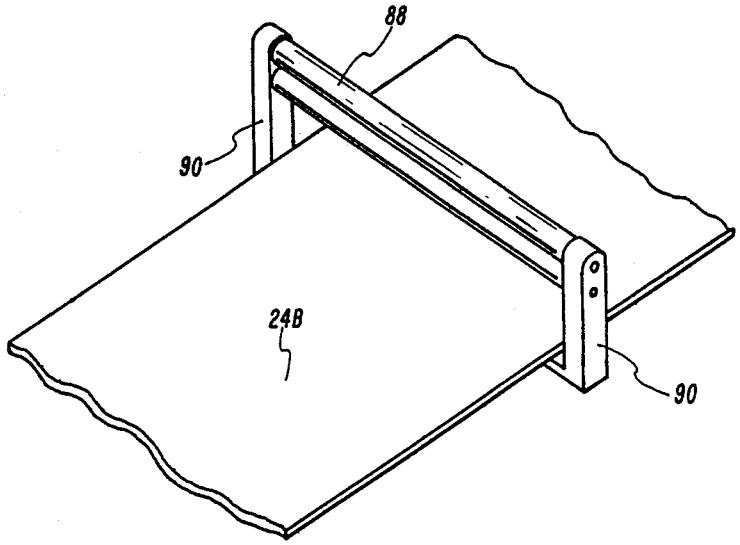

Referring to FIGS. 8A and 8B, an alternate embodiment of an apparatus for selectively lifting ramp 56 is depicted. Each tray 26 is sandwiched between a pair of rollers 88 adjacent to both leading edge 60 and trailing edge 32 of each tray 26. Rollers 88 are mounted at their respective opposite ends on support bars 90, which are positioned on opposite sides of second conveyor track 24B and are movable along with second conveyor track 24B. The upper roller 88 extends upwardly slightly higher than the upper edge of the corresponding tray 26, as best seen in FIG. 8A so that upper roller 88 engages ramp 56 and lifts it up to pave the way for tray 26 to pass beneath ramp 53 unobstructed. The corresponding rollers 88 positioned behind trailing edge 32 of each tray 26 operate in substantially the same manner to lift ramp 56 as trailing edge 32 passes underneath ramp 56, as best seen in FIGURE 8A.

Figure 9:
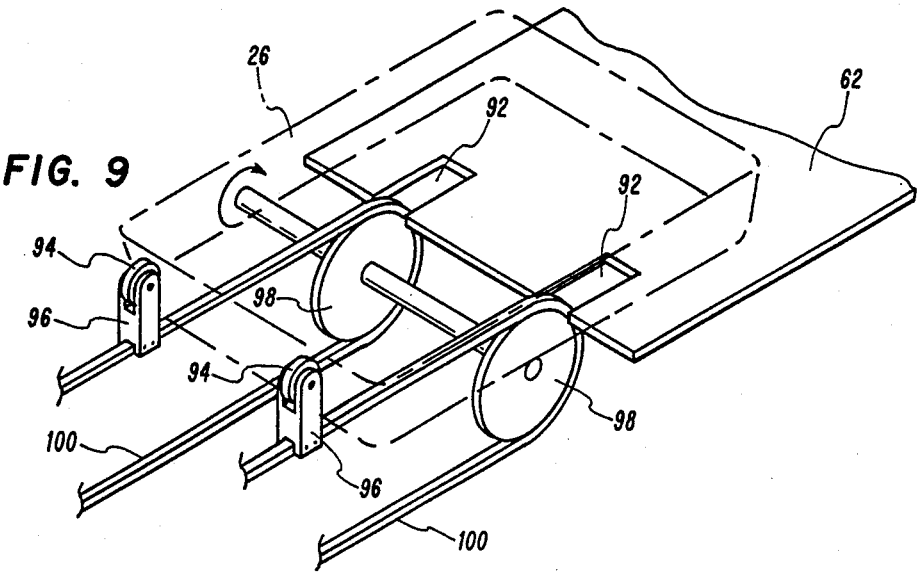
FIG. 9 is a perspective view of a second roller mechanism used to lift the packing ramp according to the present invention, illustrating the transition between movable and stationary portions of the tray conveyor track in the tray packing system according to the present invention.

Referring to FIG. 9, yet another embodiment for raising ramp 56 is depicted. The upstream edge of stationary inclined track 62 has a pair of longitudinally oriented slots 92 disposed therein for allowing a pair of rollers 94, which are mounted on respective support stands 96, to reverse directions around respective drive sprockets 98 as the respective chain members 100 reverse directions. In the embodiment shown in FIG. 9, second conveyor track 24B is comprised of parallel chain members 100 on which trays 26 are transported. Rollers 94 extend upwardly above the upper edge of each tray 26 so as to lift up ramp 56 in substantially the same manner as described above with reference to rollers 88 in FIGS. 8A and 8B. Each tray 26 is sandwiched between respective pairs of rollers 94 adjacent to leading edge 60 and trailing edge 32 of each tray 26.

Figure 10A:
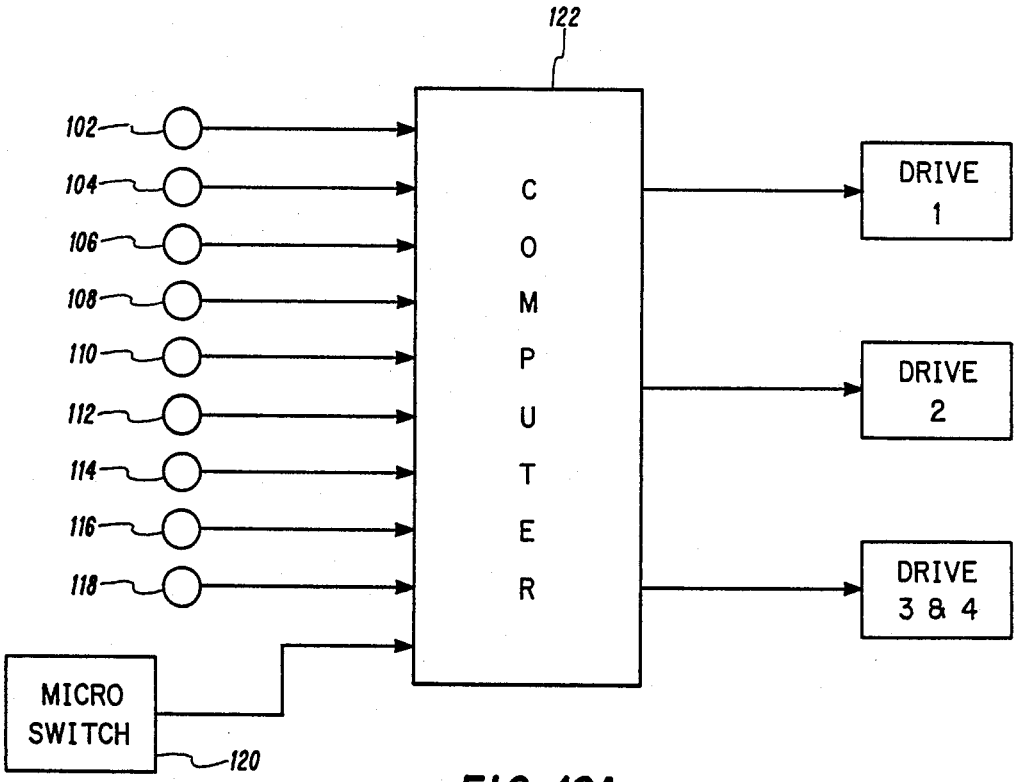
FIGS. 10A and 10B are block diagrams of the computer control apparatus for the tray packing system according to the present invention.
Figure 10B:
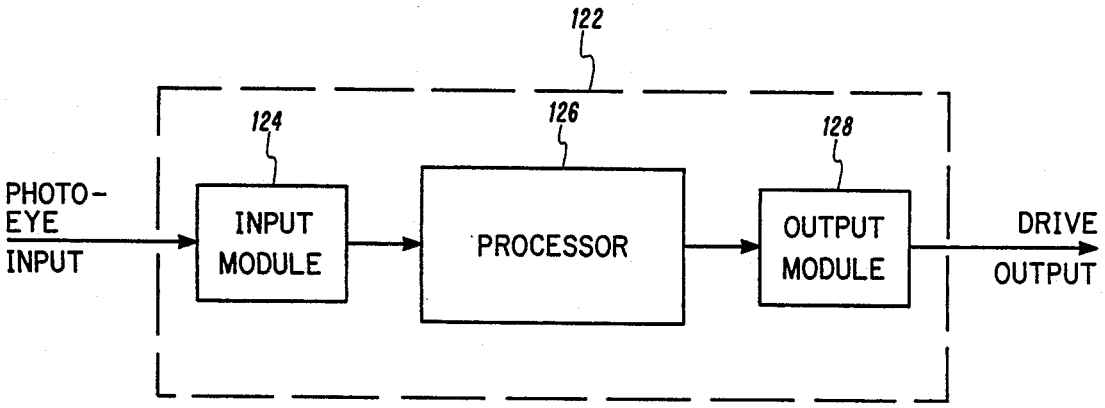

Referring again to FIG. 1 and also to FIGS. 10A and 10B, tray packing system 12 in accordance with the present invention uses a plurality of sensors to detect the presence and movement of containers 16 and trays 26 on their respective tracks. The sensors used may be photoelectric detectors (i.e., photoeyes), proximity switches, electromechanical microswitches or other suitable devices. Nine such sensors 102, 104, 106, 108, 110, 112, 114, 116, and 118 are positioned as shown in FIG. 1. The control algorithm for track packing system 12 will be described below with reference to photoeyes as being the primary sensors. One skilled in the art will appreciate, however, that other types of sensors as mentioned above can be used to achieve substantially the same result and that the invention is not limited to the use of photoeye sensors. In addition to the nine photeyes selectively positioned at various locations along the conveyor tracks, a microswitch 120 is used to detect the position of ramp 56 (i.e., whether ramp 56 is in the horizontal position or in the raised position). when ramp 56 is in the raised position, the microswitch is closed and an electrical signal indicative thereof is generated. On the other hand, when ramp 56 is in the horizontal or "down" position, the microswitch will remain open so that no electrical signal is generated.

Referring specifically to FIGS. 10A and 10B, the heart of the control system is a digital computer 122, which receives inputs from photeyes 102–118 and from microswitch 120 and controls the operation of Drives 1, 2, 3 and 4. Drives 1, 2 and 3 preferably include respective variable speed AC motors for driving first chain member 14A, second conveyor track 24B, and second and third chain members 34 and 36, respectively. Drive 4, which includes fourth and fifth chain members 52 and sprocket members 54A and 54B, is preferably mechanically slaved to Drive 3 so as to be driven in conjunction therewith.

Referring to FIG. 10B, computer 122 includes an input module 124 for receiving input signals from the various photoeyes 102–118 and microswitch 120 and reducing the voltage of the input signals to a voltage suitable for information processing by processor 126. Processor 126 is responsive to the various sensor input signals for generating respective output signals to control Drives 1, 2, 3 and 4. An output module 128, which includes one or more inverters for converting DC voltage to AC voltage, increases the voltage of the output control signals from processor 126 to operate the AC motors associated with Drives 1, 2 and 3.

Referring to FIG. 1, photoeyes 102 and 104 cooperate to detect any gaps in the flow of containers 16 along movable track 14A. The distance between photoeyes 102 and 104 is preferably less than or equal to the length of each case of containers 16, as measured longitudinally along first track 14A. Both photoeyes 102 and 104 are located upstream of leading edge 130 of fourth and fifth chain members 52. Photoeye 106 is positioned to indicate the presence of a complete case of containers 16 between dividers 50A and 50B. Photoeye 108 is used during system start-up to properly position dividers 50 to engage containers 16. Photoeye 110 is located at the upstream end of ramp 56 and is used to detect the presence of containers 16 on stationary track 14B in the area of ramp 56. Photoeye 112 is located adjacent to inclined track 24B for detecting the presence of trays 26 in the packing area. Photoeye 114 is located at the downstream end of ramp 56, above the level of trays 26, for detecting the presence of containers 16 on ramp 56. Sensors 116 and 118 cooperate to detect the presence of a blockage in the system downstream on third conveyor track 66.

Figure 11:
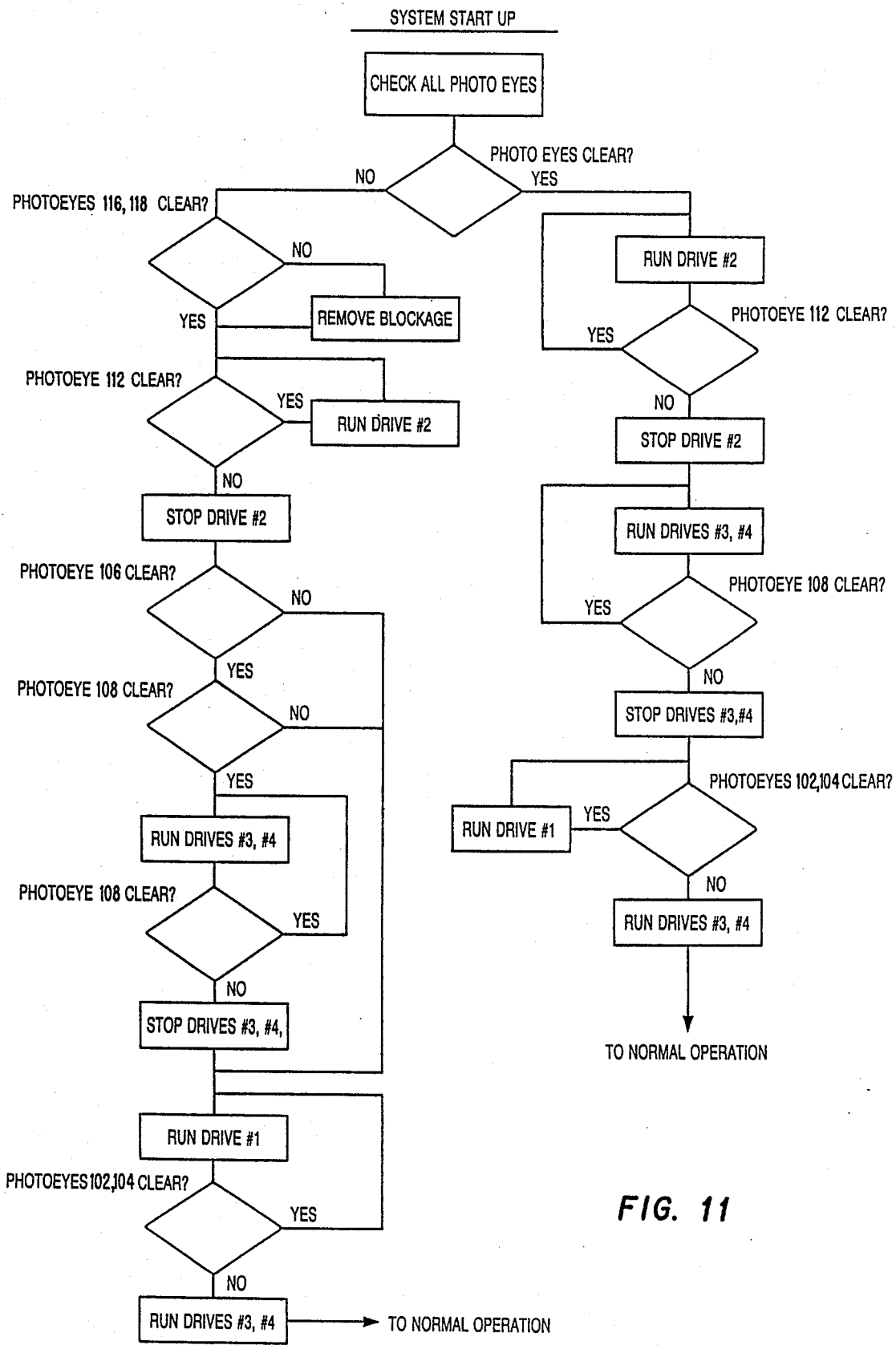
FIGS. 11–14 are flow diagrams illustrating the control algorithm for the tray packing system according to the present invention.
Figure 12:
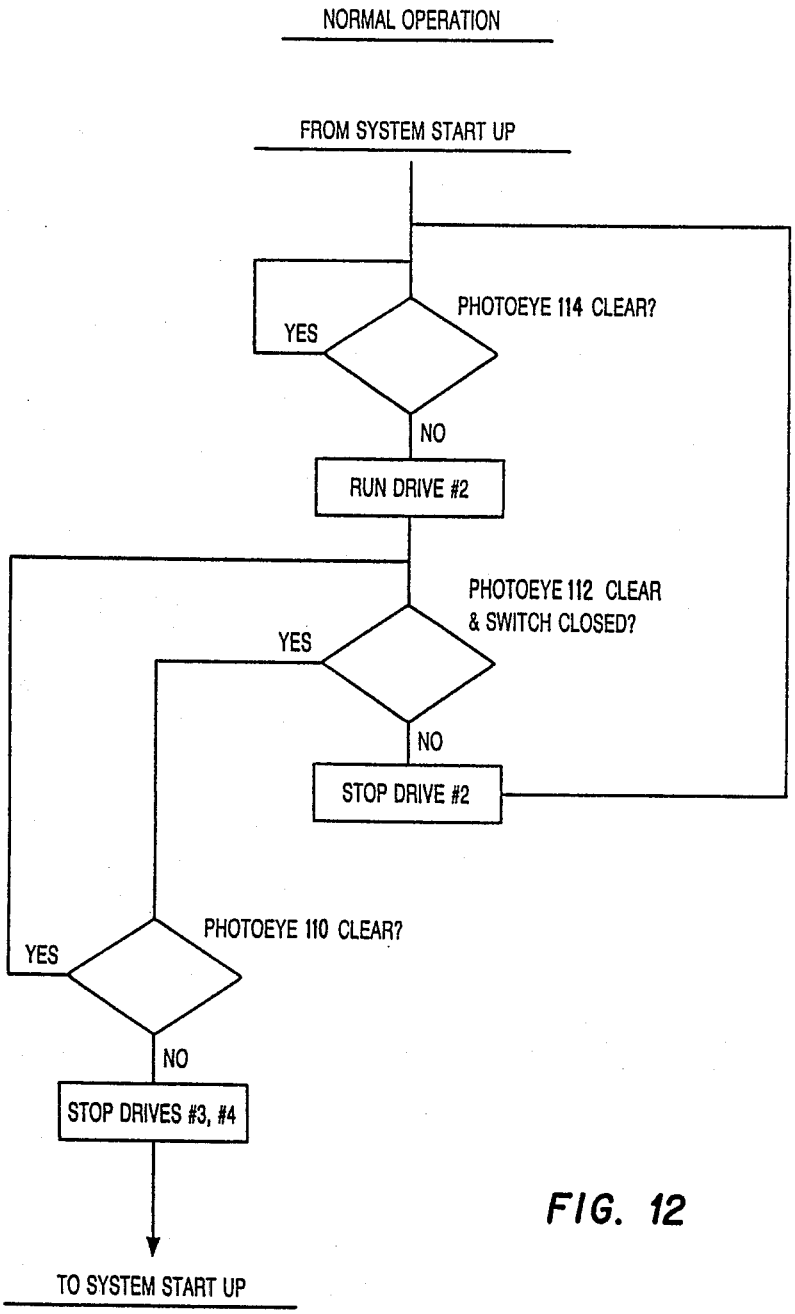

Referring to FIGS. 11–14, the control algorithm for tray packing system 12 is depicted by a series of flow diagrams. The control algorithm is preferably pre-programmed in computer 122. Referring to FIG. 11, the System Start-Up routine is depicted. If all photoeyes are "clear" (i.e., not "blocked" by an object such as container 16 or tray 26), computer 122 will operate Drive 2 until photoeye 112 is blocked, which indicates that a tray 26 is in the proper position for receiving container 16. At this point, Drive 2 is stopped and computer 122 activates Drives 3 and 4 until photoeye 108 is blocked, which indicates that dividers 50 are properly positioned to engage containers 16. Drive 1 is then started to bring containers 16 into engagement with dividers 50. When photoeyes 102 and 104 are blocked, indicating the presence of containers 16 at both positions, Drives 3 and 4 are restarted and the system enters the "Normal Operation" mode, as depicted in FIG. 12.

If, however, all of the photoeyes do not indicate "clear" at the beginning of System Start-Up, the program will branch to the sequence of steps indicated on the left side of FIG. 11. If photoeyes 116 and 118 are blocked, this indicates the presence of a downstream blockage on third conveyor track 66. This blockage must be removed so that photoeyes 116 and 118 are clear. Photoeye 112 is then checked to determine whether a tray 26 is in position at ramp 56 to receive containers 16. If photoeye 112 is clear, Drive 2 is run until photoeye 112 is blocked, which indicates that a tray 26 is properly positioned, at which time Drive 2 is stopped.

Photoeye 106 is then checked to determine whether containers 16 are properly positioned between dividers 50. If photoeye 106 is not clear, Drive 1 is activated. When photoeyes 102 and 104 indicate the presence of containers 16, Drives 3 and 4 are also activated and the system enters the "Normal Operation" mode.

If photoeye 106 is clear, photoeye 108 will be checked to determine whether dividers 50 are properly positioned. If photoeye 108 is blocked, Drive 1 will be activated to bring containers 16 into position. If photoeye 108 is clear, Drives 3 and 4 are activated until dividers 50 are in the proper position, which will occur when photoeye 108 is blocked. Drives 3 and 4 will then be stopped and will be re-started when photoeyes 102 and 104 are blocked, whereupon the system enters the "Normal Operation" mode.

Referring to FIG. 12, the normal operation of tray packing system 12 is depicted. Drive 1 runs continuously, Drive 2 runs upon demand to keep trays 26 in proper position and Drives 3 and 4 run continuously until certain conditions occur or an emergency signal is sent up to stop the entire system. During normal operation, photoeye 114 is continually checked to insure that containers 16 are in the packing position on ramp 56. Drive 2 is not activated to move trays 26 until photoeye 114 is blocked. Drive 2 will be run until photoeye 112 is blocked by a tray 26 and microswitch 120 is open (i.e., ramp 56 is horizontal). If tray 26 is not properly positioned, as indicated by photoeye 112 being clear or by microswitch 120 being closed, photoeye 110 will be checked to determine whether containers 16 are getting ready to enter the packing position on ramp 56. If photoeye 110 is blocked, Drives 2 and 4 will be stopped and the System Start-Up routine, as indicated in FIG. 11, will be used to begin operation of the system anew. If, on the other hand, photoeye 110 is clear, photoeye 112 and microswitch 120 will be checked again and Drive 2 will be stopped if a tray 26 is in the proper position to receive containers 16 (i.e., photoeye 112 is blocked and microswitch 12 is open).

Figure 13:
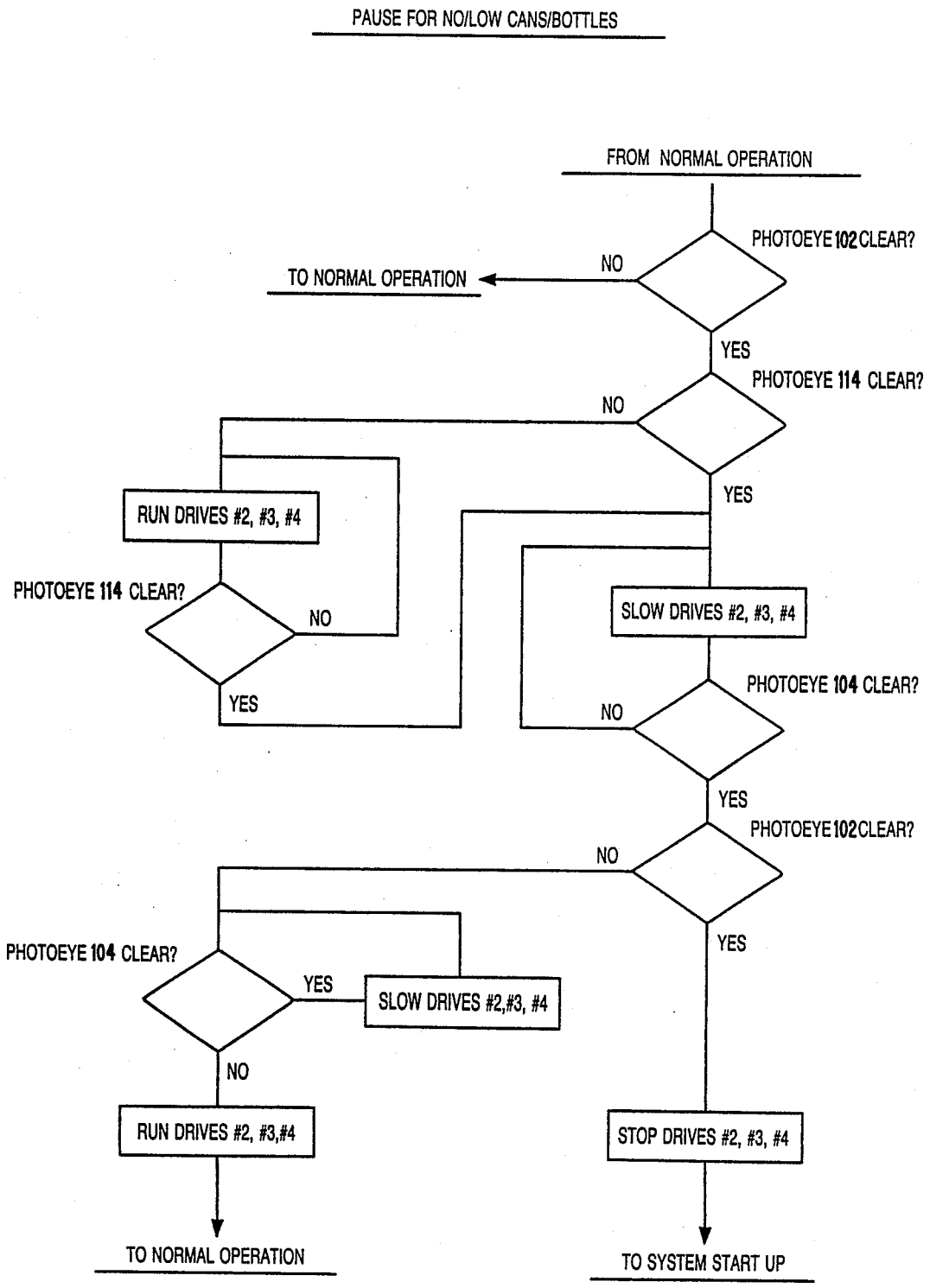

Referring to FIG. 13, an absence or an insufficient number of containers 16 on first conveyor track 14A may cause temporary pauses in the operation of tray packing system 12. If photoeye 102 is clear, photoeye 114 will be checked to see if containers 16 are in packing position on ramp 56. If photoeye 114 is clear, Drives 2, 3 and 4 will be slowed to approximately one-half their normal rates. If photoeye 114 is blocked, Drives 2, 3 and 4 will continue to run at normal speed to allow those containers 16 on ramp 56 to be loaded into the corresponding tray 26. If, after those containers 16 have been loaded, photoeye 114 indicates clear, Drives 2, 3 and 4 will be slowed. Photoeye 104 acts as a secondary indicator of a no/low container condition. If photoeye 104 is clear at the same time that photoeye 102 is clear, Drives 2, 3 and 4 will be stopped. If photoeye 102 is blocked, photoeye 104 will be checked and if it is also blocked, Drives 2, 3 and 4 will be run at full speed. If photoeye 102 is blocked and photoeye 104 is clear, Drives 2, 3 and 4 will run at slow speeds until both photoeyes 102 and 104 are blocked, which indicates sufficient containers 16 on movable track 14A for normal system operation. If Drives 2, 3, and 4 are stopped, which occurs when both photoeyes 102 and 104 are clear at substantially the same time, the System Start-Up routine will be used to continue operation of the system.

Figure 14:
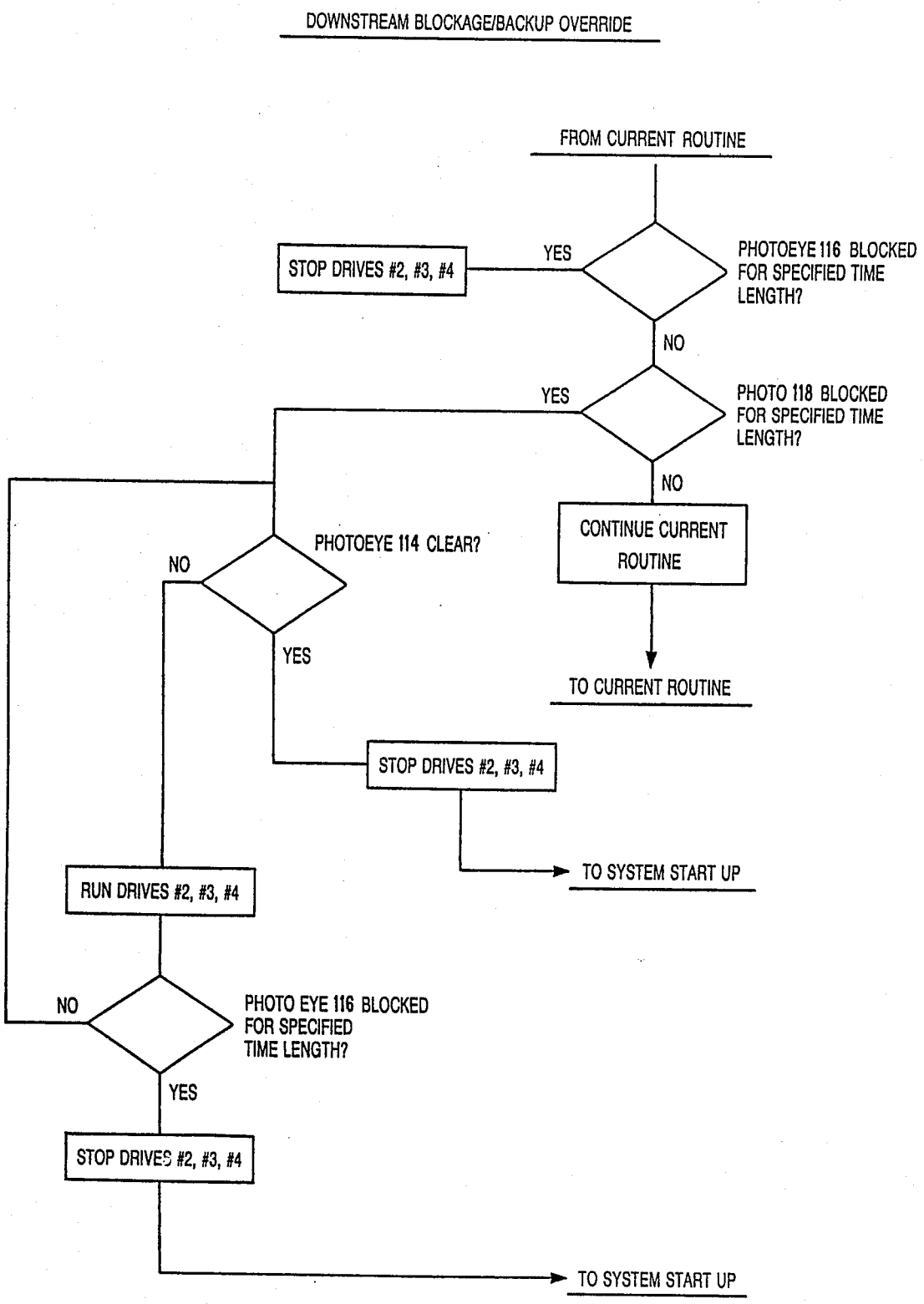
Figure 15:
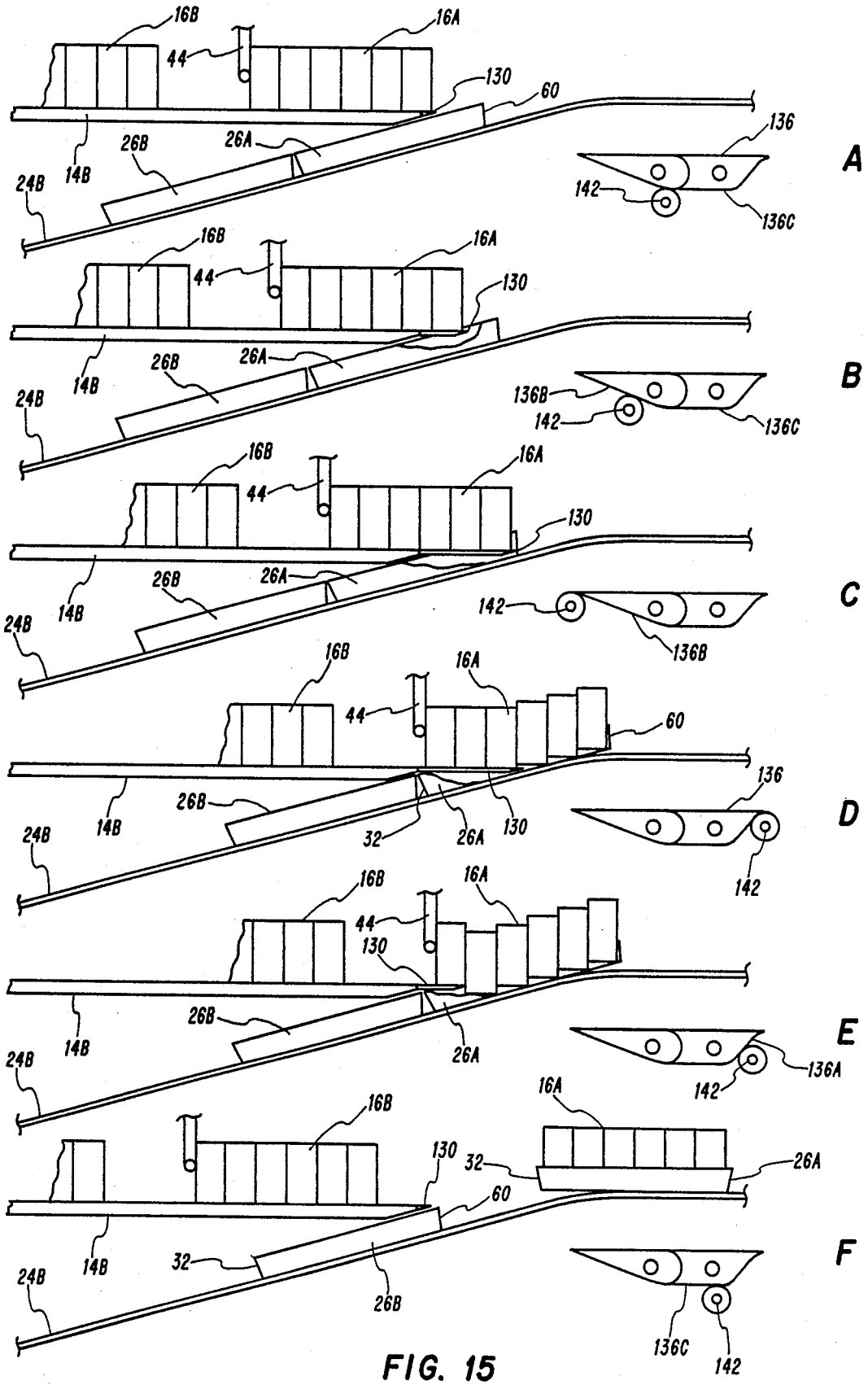
FIGS. 15A–F illustrate the sequence of steps in the packing operation in which reciprocating support members are used in lieu of the packing ramp.

Referring to FIG. 14, the control algorithm includes a sub-routine for detecting downstream blockage on third conveyor track 66. This sub-routine is run prior to all decision points in the System Start-Up, Normal Operation and Pause for No/Low Containers modes, as described with reference to FIGS. 11, 12 and 13. If photoeye 116 is blocked for a specified length of time (i.e., the normal length of time for a case of containers 16 to pass photoeye 116 plus a certain percentage of that time) Drives 2, 3, and 4 are stopped. If photoeye 116 is not blocked, but photoeye 118 is blocked for the aforementioned specified length of time, photoeye 114 will be checked to determine if containers 16 are in the packing position on ramp 56. If photoeye 114 is blocked, Drives 2, 3 and 4 will be run until either photoeye 116 is blocked for the specified length of time or until photoeye 114 is clear, indicating that there are no containers 16 in the packing position on ramp 56. When Drives 2, 3 and 4 are stopped, the program will branch to the System Start-Up mode, as depicted in FIG. 11.

Figure 16:
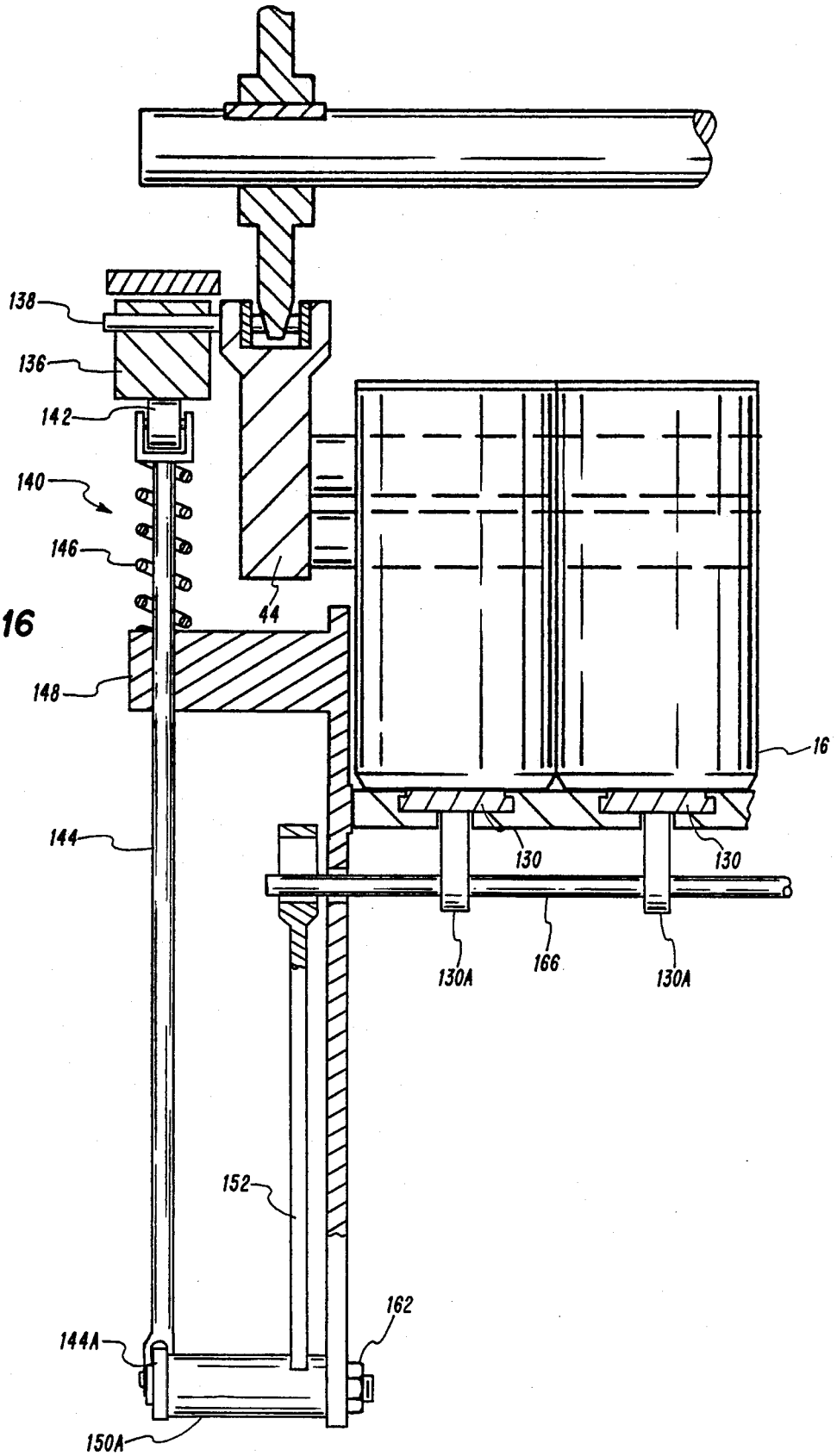
FIG. 16 is an end elevation view of the push rod follower mechanism used to operate the support members shown in FIGS. 15A–15F.
Figure 17:
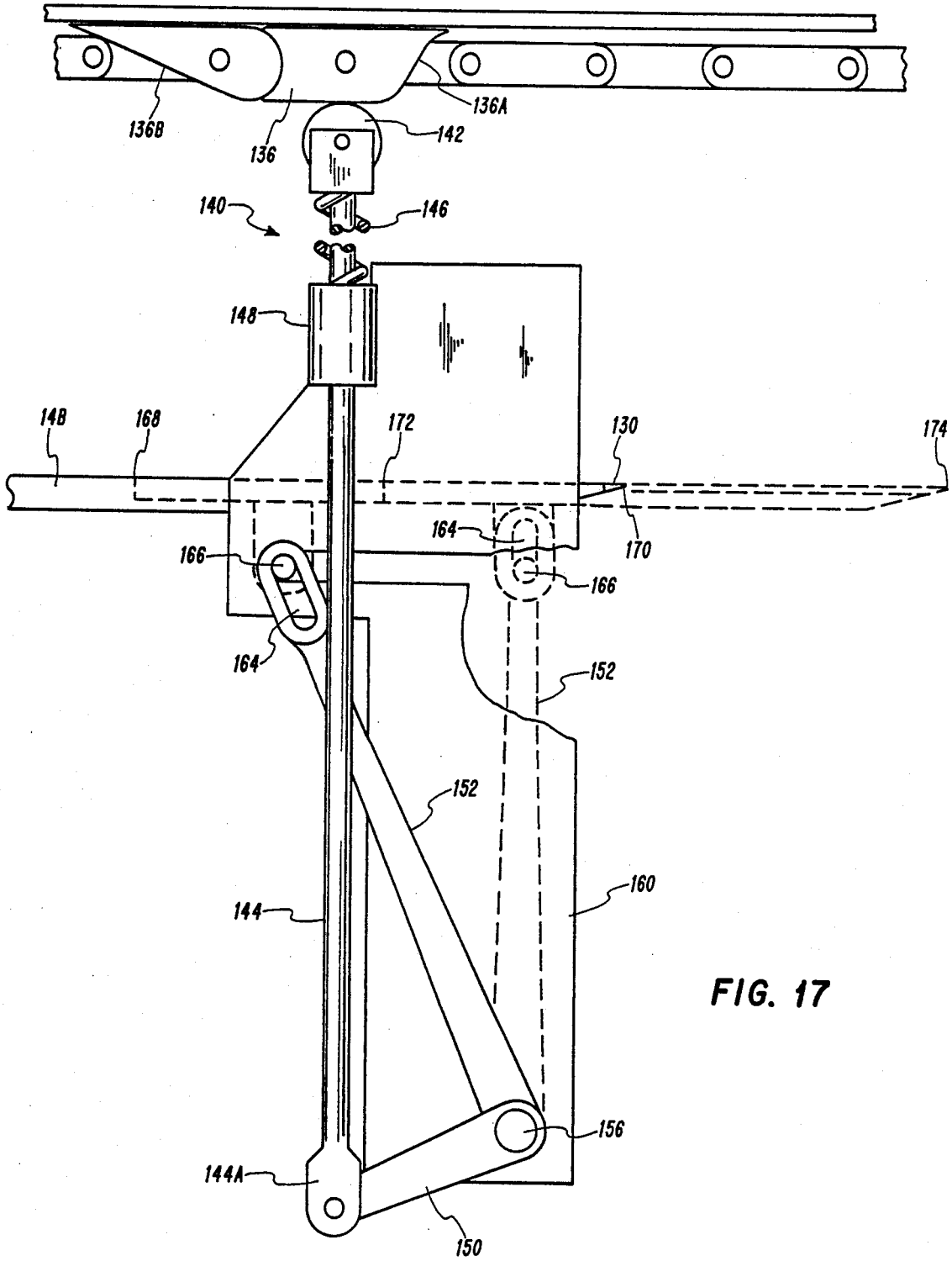
FIG. 17 is a side elevation view of the push rod follower mechanism shown in FIG. 16.
Figure 18:
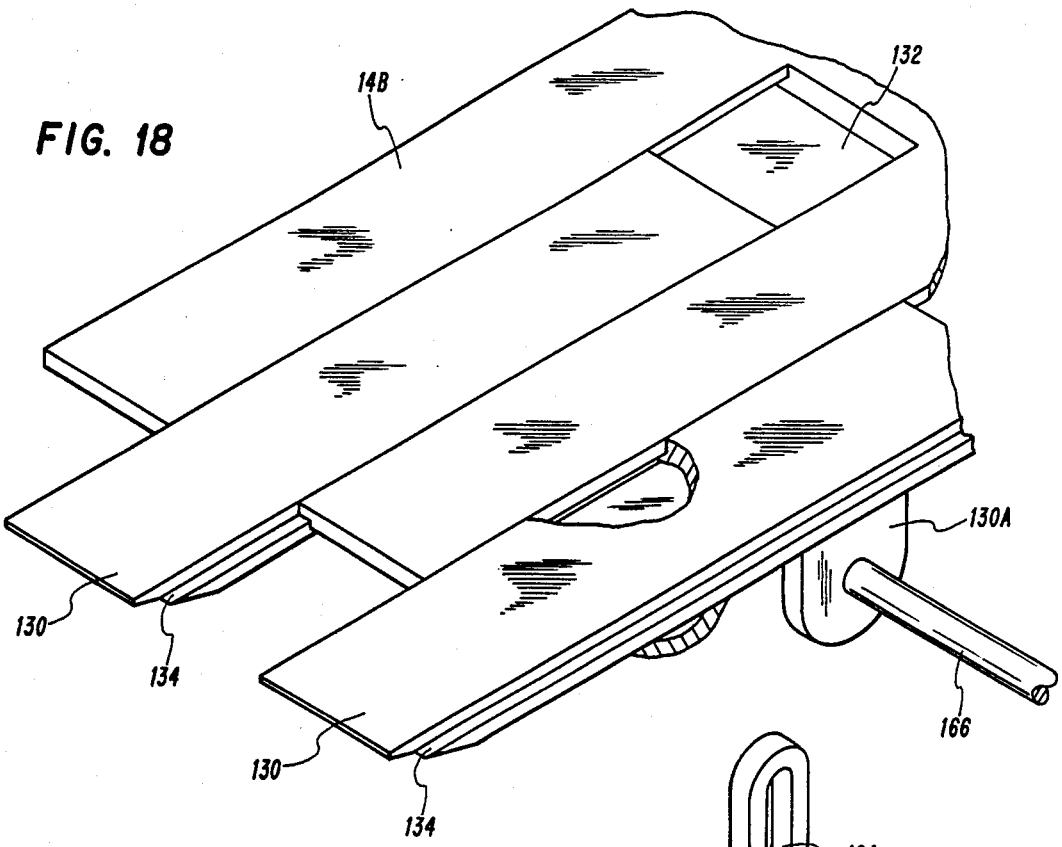
FIG. 18 is a perspective view of the reciprocating support members.

Referring to FIGS. 15–19, an alternate embodiment of the tray packing system according to the present invention is depicted. Instead of pivotally attaching a ramp member at the downstream end of stationary track 14B, a plurality of reciprocally movable support members 130 are disposed at the downstream end of stationary track 14B, adjacent to the intersection of inclined track 23B with stationary track 14B. As best seen in FIGS. 16 and 18, each support member 130 is received within a corresponding elongated opening 132 in stationary track 14B. Each support member 130 is preferably comprised of a relatively flat, elongated member, having respective projecting portions 134 extending longitudinally on opposite sides thereof. Projecting portions 134 engage respective facing surfaces of stationary track 14B to constrain the corresponding support member 130 from moving along a vertical axis which is normal with respect to the major surface of stationary track 14B.

As each group of containers 16 is moved into position for being packed into the corresponding tray 26, each column of containers 16 (in which individual containers 16 are oriented longitudinally with respect to stationary track 14B) of the corresponding group will be journally supported from below by a corresponding one of support members 130. Thus, the number of support members 130 will be the same as the number of columns in the corresponding group of containers 16. For example, if a group consists of a standard case of twenty-four containers 16, the group may be arranged so that each row has four containers and each column has six containers. In that event, the number of columns and the number of support members 130 are each equal to four. Only two columns and two coresponding support members 130 are depictd in FIG. 16.

Reciprocating motion is imparted to support members 130 as follows. A plurality of cams 136 are attached by means of respective link pins 138 to each of second and third chain members 34 and 36 at predetermined locations therealong. A push rod follower mechanism 140 is mounted on each side of stationary track 14B for engaging each cam 136 as each cam 136 moves past push rod followers 140 along with the respective second and third chain members 34 and 36.

Figure 19:
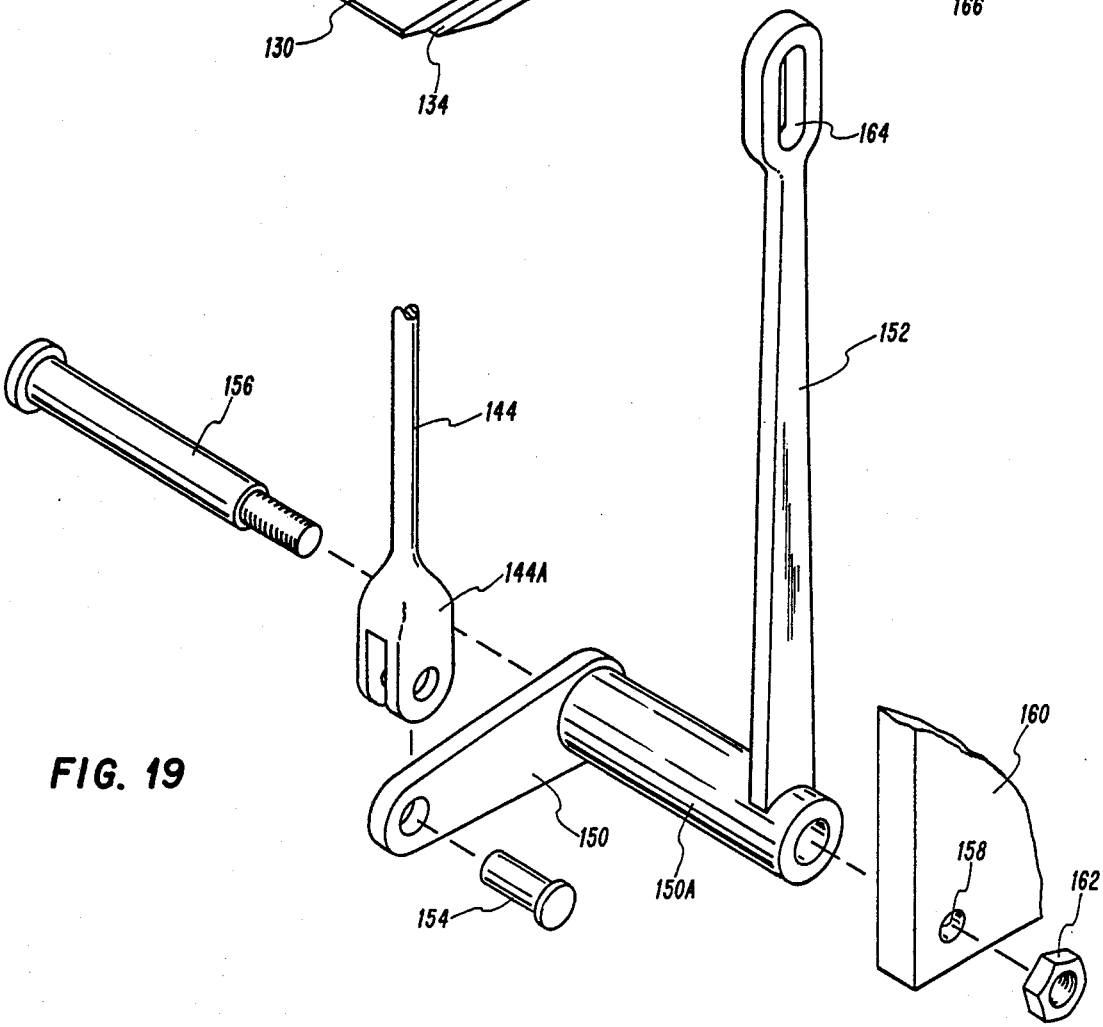
FIG. 19 is a perspective view of the major components of the push rod follower mechanism.

Each push rod follower 140 includes a cam follower 142 for engaging cams 136, an elongated shaft 144 in which spring member 146 is mounted, a guide 148, which constrains shaft 144 to move in a substantially vertical direction, an L-shaped member 150 and an elongated arm member 152. Shaft 144 includes a forked portion 144A at one end thereof for being attached to a first end of L-shaped member 150 by means of a pin member 154, as best seen in FIG. 19. Arm member 152 is attached at one end thereof to a second end of L-shaped member 150 so that arm member 152 will rotate together with L-shaped member 150. Shaft 144 is attached to L-shaped member 150 in such a manner that the vertical motion of shaft 144 will impart rotary motion to L-shaped member 150 and arm member 152. L-shaped member 150 includes a sleeve portion 150A having a central bore for receiving a shoulder bolt 156 therethrough. Shoulder bolt 156 extends through the central bore in sleeve portion 150A and through opening 158 in a mounting plate 160, which is attached to stationary track 14B. An hexagonal nut 162 engages the end of shoulder bolt 156, which penetrates through opening 158 to attach push rod follower mechanism 140 to stationary track 14B.

As best seen in FIG. 17, the vertical motion of shaft 144 is converted to rotary motion of L-shaped member 150 and arm member 152, which in turn imparts reciprocating motion to support members 130. At the opposite end of arm member 152 from the end which is secured to sleeve portion 150A is an elongated slot 164 in which an end portion of a connecting rod 166 is received. When cam followers 142 are in engagement with respective cams 136, as shown in FIGURE 17, the spring bias of spring member 146 will be overcome, thereby moving shaft 144 downwardly and causing L-shaped member 150 and arm member 152 to rotate in a counterclockwise direction when viewed from the perspective of FIG. 19. This motion causes the end of arm member 152 at which elongated slot 164 is disposed to move upstream along stationary track 14B. This upstream motion is transmitted to support members 130 by means of connecting rod 166, which is attached to the respective tongue portions 130A of support members 130, to move support members 130 to their retracted positions. When support members 130 are fully retracted, their respective upstream ends are approximately at the position indicated at 168 and their respective downstream ends are approximately at the position indicated at 170. The respective downstream ends of support members 130 and stationary track 14B are beveled to facilitate the passage of trays 26 as trays 26 move upwardly along inclined track 24B.

Conversely, when cam followers 142 are not in engagement with respective cams 136, the spring bias of spring member 146 will move shaft 144 upwardly, which will impart rotary motion to L-shaped member 150 and arm member 152 in a clockwise direction when viewed from the perspective of FIG. 19. This rotary motion in turn causes the end of arm member 152 at which elongated slot 164 is disposed to move downstream. This downstream motion will be imparted to support members 130 by means of connecting rod 166 so that support members 130 will be moved to their fully extended position. When support members 130 are in the fully extended position, their respective upstream ends are approximately at the position indicated at 172 and their reespective downstream ends are approximately at the position indicated at 174. When support members 130 are in their fully extended position, arm member 152 will be oriented substantially vertically, as indicated by the dashed lines in FIG. 17. Leading surface 136A of each cam 136 is sloped more than trailing surface 136B so that support members 130 will be moved from the fully extended position to the fully retracted position faster than they will be moved from the fully retracted position to the fully extended position to ensure that sufficient clearance is available for the passage of trays 26.

FIGS. 15A–15F illustrate the sequence of packing a group of containers 16A into a tray 26A. The relative positions of cam followers 142 and the corresponding cams 136 at the respective positions in the packing sequence are illustrated alongside the corresponding positions. As shown in FIG. 15A, support members 130 are fully retracted when cam followers 142 engage the relative flat central portions 136C of the corresponding cams 136. At this point, leading edge 60 of tray 26A has cleared the downstream end of track 14B and the leading row of containers of group 16A is at the downstream end of track 14B. In FIG. 15B, cam followers 142 engage the corresponding trailing surfaces 136B, the upward slope of which allows support members 130 to gradually return to their fully extended position, as shown in FIG. 15C. In FIG. 15C, support members 130 are fully extended and are received within the mouth of tray 26A. The leading three rows of containers 16 in container group 16A are being journally supported by support members 130. Cam followers 142 are disengaged from the corresponding cam 136.

FIGS. 15D and 15E illustrate the packing of container group 16A into tray 26A in sequence from leading edge 60 to trailing edge 32. The first three rows slide smoothly off support members 130 into tray 26A as flight bars 44 continue to push containers 16 off the downstream ends of support members 130 and tray 26A continues to move upwardly along track 24B. Support members 130 will remain fully extended until cam followers 142 engage the respective leading surfaces 136A of the next set of cams 136 in sequence, as shown in FIG. 15E. Support members 130 will begin to retract and those containers 16 still on support members 130 when the retractive motion begins will drop a short vertical distance downward into tray 26A (although less than the vertical drop required when ramp member 56 is used).

In FIG. 15F, cam followers 142 are shown in engagement with the respective central portions 136C of the corresponding cam 136 and support members 130 are fully retracted. Support members 130 are retracted before trailing edge 32 of tray 26A reaches the downstream end of track 14B and will remain fully retracted until leading edge 60 of the next tray 26B in sequence clears the downstream end of track 14B, as shown in FIG. 15F. Thus, the length of central portion 136C of each cam 136 along the upstream-downstream axis must be sufficient to maintain support members 130 in a substantially fully retracted position during the time interval beginning just prior to the arrival of trailing edge 32 of tray 26A at the downstream end of track 14B to just after the arrival of leading edge 60 of tray 26B at the downstream end of track 14B. The packing cycle can then begin anew, as shown in FIG. 15A, with respect to the next container group 16B in sequence.

One skilled in the art will appreciate that means other than the cam and push rod follower device described above can be used to impart reciprocating motion to the support members. For example, a rotary crank mechanism can also be used to impart the reciprocating motion.

The use of reciprocating support members in lieu of a pivoting ramp member increases the speed of operation of the system by closing up the gaps between successive groups of containers. Because the support members do not have to be returned to a horizontal position, as does the ramp member described above, the next group of containers in succession can be positioned on the respective support members while the support members are being moved from their retracted positions to their fully extended positions. By speeding up the packing operation, the length of the inclined track can also be reduced, which allows the trays to be returned to their stable horizontal positions substantially sooner. Another advantage of using the reciprocating support members is that the support members are retracted out of the way of the trailing edge of the oncoming tray substantially simultaneously with the packing of the last row of containers in the corresponding group, so that the tray can be returned to a substantially horizontal position substantially simultaneously, which allows the use of a substantially vertical-walled container instead of a container in which the walls have a predetermined draft angle. Therefore, substantially the same internal storage space can be provided with a smaller exterior-sized tray when a vertical-walled tray is used.

The system and method according to the present invention is suitable for use in connection with returnable or non-returnable low depth trays and is able to pack containers either in pre-formed six-packs, eight-packs and twelve-packs or in a loose state into transport trays in a continuous motion without having to unnecessarily slow down or interrupt the movement of the containers and trays. The system and method of the present invention further provide substantial cost savings by providing a tray packed which is able to pack 70–80 cases per minute using a simpler, less expensive technique. The approximate cost of the automated system according to the present invention is on the order of $40,000–$70,000. The fact that the system can be used in conjunction with certain returnable trays offers an additional substantial cost advantage over prior art systems, such as the tray former loader, which require new trays to be used during each operation. The automated system according to the present invention also has substantial advantages over such prior art systems as the vertical drop packer and the ski packer by providing substantially faster operation and tray packing speeds without unnecessary slowdowns or interruptions in operation.

Various embodiments of the invention have now been described in detail. Since it is obvious that many changes in and additions to the above-described preferred embodiment may be made without department from the spirit and scope of the invention, the invention is not to be limited to said details, except as set forth in the appended claims.

What is claimed is:

1. A system for packing containers into corresponding transport trays, comprising:

first conveyor means for transporting said containers along a first track;

means for dividing said containers into selected groups, the number of containers in each group corresponding to the number of containers to be packed into each tray;

second conveyor means for transporting said trays along a second track, a portion of said second track being inclined with respect to said first track so that first and second tracks converge at a predetermined location;

a support member disposed adjacent to said predetermined location for journally supporting said containers as said containers are being packed into the corresponding tray, said support member being reciprocally moveable along an upstream-downstream axis between a first position at which said support member is substantially fully extended for introducing a corresponding group of containers into the corresponding tray and a second position at which said support member is substantially fully retracted for allowing the trailing edge of the corresponding tray to clear said support member as said tray is moved along the inclined portion of the second track after all of the containers in the corresponding group have been packed into the tray; and means for controlling the movements of the containers on the first track and the trays on the second track so that each group of containers is packed in into the corresponding tray in succession from the leading edge to the trailing edge of the tray while the tray is being moved upwardly along the inclined portion of the second track.

2. The system according to claim 1 further including means for selectively moving said support member between said first and second positions, said moving means being comprised of cam means which is moveable along said first track and stationary spring-loaded push rod follower means coupled to said support member for engaging said cam means as said cam means is moved along said first track, said cam means for exerting downward pressure on said push rod follower means to move said support member to said second position when said cam means is in engagement with said push rod follower means, said push rod follower means for being moved upwardly by spring-bias when said push rod follower means is not in engagement with said cam means, to move said support member to said first position.

3. The system according to claim 2 wherein said push rod follower means is comprised of a spring-loaded push rod follower, the major axis of which is oriented substantially orthogonal with respect to the major surface of said first track so that said push rod follower is moveable along its major axis, and linkage means coupled between said push rod follower and said support member for translating the axial motion of said push rod follower into corresponding reciprocating motion of said support member along the upstream-downstream axis of the first track.

4. The system according to the claim 3 wherein said cam means is comprised of a pluraity of cams disposed at predetermined positions on said first conveyor means so that one of said cams comes into engagement with said push rod follower means while a corresponding group of containers is being packed into the corresponding tray, to begin moving support member from said first position to said second position.

5. The system according to claim 4 wherein each of said cams has a length along the upstream-downstream axis which is sufficient to engage the push rod follower means to maintain the support member in the second position during the time period beginning just prior to the arrival of the trailing edge of the corresponding tray at said predetermined location.

6. The system according to claim 1 wherein said system includes a plurality of support members, each support member being comprised of a relatively flat elongated member, said first track including a corresponding plurality of complementary elongated openings therein for receiving respective ones of said support members when said support members are moved from said first position to said second position, each of said support members for journally supporting a corresponding column of containers, in which the individual containers are arranged along the upstream-downstream axis, when a group of containers is being journally supported by the support members.

7. The system according to claim 6 wherein each of said support members includes an extension portion for engaging a corresponding facing surface of the first track for preventing the corresponding support member from being moved along an axis which is normal with respect to the major surface of the first track.

8. The system according to claim 1 wherein said first track is comprised of a moveable portion and a stationary portion, said stationary portion being downstream of said moveable portion, said support member being attached to the downstream end of said stationary portion.

9. The system according to claim 8 wherein said first conveyor means includes first, second and third sprocket-driven chain means arranged to form respective first, second and third continues vertical loops, a portion of said first chain means defined said moveable portion of said first track and said second and third chain means for moving said groups of containers along said stationary portion of said first track.

10. The system according to claim 9 wherein each of said second and third chain means includes a plurality of projection members extending outwardly therefrom for engaging respective groups of containers to move said respective groups of containers along the stationary portion of the first track.

11. The system according to claim 10 wherein corresponding ones of said projection members on said second and third chain means are coupled together by means of laterally extending roller members, said roller members for contacting the tailing row of containers in each group of containers to move the corresponding group of containers along the first track at substantially the same speed as the projection members.

12. The system according to claim 10 wherein said dividing means is comprised of a plurality of elongated dividers mounted at selected positions on fourth and fifth sprocket-driven chain means, said dividers for being interposed between selected containers on the moveable track for dividing the containers into discrete groups with a predetermined number of containers in each group, adjacent ones of said dividers being separated by a distance approximately equal to the length of a container group, as measured along the upstream-downstream axis.

13. The system according to claim 12 wherein said projection means engage the trailing row of containers in the respective groups of containers to move each group of containers onto the support member and into a corresponding tray while said tray is moving on the inclined portion of said second track, said containers being maintained in a substantially vertical orientation so that the respective bottom surfaces of the containers are oriented at an acute angle with respect to the bottom surface of the tray while said tray is moving on the inclined portion of the second track.

14. The system according to claim 13 wherein selected portions of said second and third chain means slope gradually downward so that said projection members engage the respective trailing rows of containers sufficiently low on the respective surfaces of said containers to maintain the stability of the containers.

15. The system according to claim 13 further including third conveyor means for transporting the packed tray to a predetermined destination, said third conveyor means including a substantially horizontal third track on which said packed tray is moved, said containers being oriented substantially orthogonally with respect to the bottom surface of said tray so that the respective bottom surfaces of said containers are substantially in contact with the bottom surface of said tray when said packed tray is on the third track.

16. The system according to claim 1 wherein said control means is comprised of:

first detector means for generating a first electrical signal when a container is present at a first selected position on said first track substantially upstream from said support member;

second detector means for generating a third electrical signal when a container is present at a selected position on said support member;

third detector means for generating a third electrical signal when a tray is at a selected position on said second track in proximity to said support member;

fourth detector means for generating a fourth electrical signal when said support member is in the first position;

means for activating said first conveyor means to transport containers on the first track in response to the presence of said first electrical signal and for deactivating said first conveyor means in response to the absence of said first and third electrical signals; and means for activating said second conveyor means to transport trays on said second track in response to either the absence of said third electical signal when the first conveyor means is deactivated or the presence of said second electrical signal when said first conveyor means is activated and for deactivating said second conveyor means in response to either said third electrical signal when said first conveyor means is deactivated or to the presence of said third and fourth electrical signals in the absence of said second electrical signal when the first conveyor means is activated.

17. The system according to claim 16 wherein said first track is comprised of a moveable portion and a stationary portion downstream of said moveable portion and said first conveyor means includes first, second and third sprocket-driven chain means arranged to form respective first, second and third continuous vertical loops, a portion of said first chain means defining said moveable portion of said first track and said second and third chain means for moving said groups of containers along said stationary portion of said first track.

18. The system according to claim 17 wherein said dividing means includes fourth and fifth sprocket-driven chain means and said system further includes first drive means for driving said first chain means, second drive means for driving said second conveyor track, third drive means for driving said second and third chain means and fourth drive means for driving said fourth and fifth chain means.

19. The system according to claim 18 wherein said control means further includes fifth detector means for generating a fifth electrical signal when said dividing means is properly positioned with respect to said containers, said fourth drive means being activated in response to the absence of said fifth electrical signal to position said dividing means as desired with respect to said containers and being deactivated in response to the presence of said fifth electrical signal when said first drive means is deactivated.

20. The system according to claim 19 wherein said control means further includes sixth detector means positioned downstream from said first detector means for generating a sixth electrical signal when containers are present between adjacent ones of said dividing means, said first drive means being activated in response to said sixth electrical signal when said fourth drive means is deactivated.

21. The system according to claim 20 wherein said control means further includes seventh detector means positioned downstream from said first detector means in proximity to said support members and upstream thereof, for generating a seventh electrical signal when a container is present at the position of the seventh detector means, said first, second, third and fourth drive means being deactivated in response to said seventh electrical signal when said third electrical signal is not generated.

22. The system according to claim 21 wherein said system further includes third conveyor means for transporting the packed tray to a predetermined destination, said third conveyor means including a third track located downstream of said first and second conveyor tracks, and eighth detector means for detecting the presence of packed trays at selected positions on the third track and for generating an eighth electrical signal when the presence of a packed tray is detected for a predetermined length of time, thereby indicating a blockage downstream on the third track, said first, second, third and fourth drive means being deactivated in response to said eighth electrical signal.

* * * * *